US011231186B2

(12) United States Patent
Kojima

(10) Patent No.: US 11,231,186 B2
(45) Date of Patent: Jan. 25, 2022

(54) REFRIGERATION UNIT WITH A LIQUID HEAT SOURCE AND REDUCED CONDENSATION AT A UTILIZATION UNIT

(71) Applicant: Daikin Industries, LTD., Osaka (JP)

(72) Inventor: Akiharu Kojima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/619,312

(22) PCT Filed: Jul. 17, 2018

(86) PCT No.: PCT/JP2018/026764

§ 371 (c)(1),
(2) Date: Dec. 4, 2019

(87) PCT Pub. No.: WO2019/017351

PCT Pub. Date: Jan. 24, 2019

(65) Prior Publication Data

US 2020/0132314 A1 Apr. 30, 2020

(30) Foreign Application Priority Data

Jul. 20, 2017 (JP) ..... JP2017-141341

(51) Int. Cl.

| | |
|---|---|
| ***F24F 1/24*** | (2011.01) |
| ***F24F 11/84*** | (2018.01) |
| ***F24F 11/30*** | (2018.01) |
| ***F24F 11/87*** | (2018.01) |
| ***F24F 3/06*** | (2006.01) |
| ***F25B 13/00*** | (2006.01) |
| ***F25B 49/02*** | (2006.01) |

(52) U.S. Cl.

CPC ..... *F24F 1/24* (2013.01); *F24F 3/065* (2013.01); *F24F 11/30* (2018.01); *F24F 11/84* (2018.01);

(Continued)

(58) Field of Classification Search

CPC .. F24F 11/30; F24F 11/84; F24F 11/87; F24F 1/24; F24F 3/065; F25B 13/00; F25B 49/02

See application file for complete search history.

(56) References Cited

U.S. PATENT DOCUMENTS 9,784,461 B2 * 10/2017 Billman ..... F24F 11/30
10,508,826 B2 * 12/2019 Takenaka ..... F25B 41/31

(Continued)

FOREIGN PATENT DOCUMENTS

EP 1 826 509 A2 8/2007
JP 9-72625 A 3/1997

(Continued)

OTHER PUBLICATIONS

English translation of the International Preliminary Report on Patentability and Written Opinion of the International Searching Authority, dated Jan. 30, 2020, for International Application No. PCT/JP2016/026764.

(Continued)

*Primary Examiner* — Henry T Crenshaw
(74) *Attorney, Agent, or Firm* — Birch, Stewart, Kolasch & Birch, LLP

(57) ABSTRACT

An air conditioner includes a heat source unit having a compressor, a first heat exchanger configured to cause heat exchange between a refrigerant and liquid fluid, a second heat exchanger configured to cause heat exchange between the refrigerant and air, and a valve configured to switch to supply or not to supply the second heat exchanger with the refrigerant, and a controller configured to control to operate the compressor and to open or close the valve. The controller opens the valve to supply the second heat exchanger with the refrigerant to cause the second heat exchanger to function as a heat absorber when assessing that the refrigerant sent to the utilization unit needs to be decreased in quantity during (Continued)

cooling operation in which the first heat exchanger functions as a radiator.

10 Claims, 12 Drawing Sheets

(52) U.S. Cl.
CPC ..... *F24F 11/87* (2018.01); *F25B 13/00* (2013.01); *F25B 49/02* (2013.01)

(56) References Cited

U.S. PATENT DOCUMENTS

2015/0090803 A1* 4/2015 Okamoto ..... F24D 5/02 237/2 A
2016/0377312 A1* 12/2016 Kojima ..... F24F 1/0003 165/247
2017/0211833 A1* 7/2017 Tran ..... F24F 11/30

FOREIGN PATENT DOCUMENTS

| | | | | |
|---|---|---|---|---|
| JP | 10-176869 | A | | 6/1998 |
| JP | 10-176896 | | * | 6/1998 |
| JP | 2001-099512 | | * | 4/2001 |
| JP | 2001-99512 | A | | 4/2001 |
| JP | 2008-14545 | A | | 1/2008 |
| JP | 2016-191505 | A | | 11/2016 |

OTHER PUBLICATIONS

International Search Report, dated Oct. 16, 2018, for International Application No. PCT/JP2018/026764, with an English translation.

* cited by examiner

REFRIGERATION UNIT WITH A LIQUID HEAT SOURCE AND REDUCED CONDENSATION AT A UTILIZATION UNIT

TECHNICAL FIELD

The present invention relates to a refrigeration apparatus, particularly to a refrigeration apparatus using liquid fluid as a heat source.

BACKGROUND ART

There has been conventionally known a refrigeration apparatus using liquid fluid as a heat source (see e.g. Patent Literature 1 (JP 2016-191505 A)).

If such a refrigeration apparatus continuously operates without lowering cooling capability of a heat source unit even when a utilization unit has decreased in cooling load during cooling operation in which a liquid fluid heat exchanger included in the heat source unit functions as a radiator, a refrigerant flowing in a utilization heat exchanger excessively decreases in temperature to possibly cause dew condensation, or freezing at the utilization heat exchanger. Such a refrigeration apparatus thus typically controls to decrease capacity of a compressor or the like in accordance with decrease in load at the utilization unit.

SUMMARY OF THE INVENTION

Technical Problem

Even with such control to decrease the capacity of the compressor or the like, the cooling capability may sometimes still be excessive under a certain operation condition.

In view of this, there may be provided, in a refrigerant circuit, a bypass pipe connecting a discharge tube and a suction tube of the compressor for control to cause a refrigerant discharged from the compressor to partially pass through the bypass pipe when the heat source unit has excessive cooling capability. Such a configuration may still have problems. For example, bypassing may be insufficient for the excessive cooling capability, and the refrigerant passing through the bypass pipe may generate noise.

It is an object of the present invention to provide a refrigeration apparatus that uses liquid fluid as a heat source and is highly reliably configured to reduce the occurrence of dew condensation at a utilization unit and freezing at a utilization heat exchanger during cooling operation in which a liquid fluid heat exchanger in a heat source unit functions as a radiator.

Solution to Problem

A refrigeration apparatus according to a first aspect of the present invention includes a heat source unit, a utilization unit, and a controller. The heat source unit includes a compressor, a first heat exchanger, a second heat exchanger, a casing, and a valve. The compressor compresses a refrigerant. The first heat exchanger causes heat exchange between the refrigerant and liquid fluid. The second heat exchanger causes heat exchange between the refrigerant and air. The casing accommodates the compressor, the first heat exchanger, and the second heat exchanger. The valve switches to supply or not to supply the second heat exchanger with the refrigerant. The utilization unit includes a utilization heat exchanger. The utilization unit and the heat source unit constitute a refrigerant circuit. The controller controls to operate the compressor and open or close the valve. The controller opens the valve to supply the second heat exchanger with the refrigerant to cause the second heat exchanger to function as a heat absorber when assessing that the refrigerant sent to the utilization unit needs to be decreased in quantity during cooling operation in which the first heat exchanger functions as a radiator.

According to this aspect, when the refrigerant sent from the heat source unit to the utilization unit needs to be decreased in quantity during operation in which the first heat exchanger (a liquid fluid heat exchanger) functions as a radiator, the refrigerant is sent to the second heat exchanger (an air heat exchanger) to cause the second heat exchanger to function as a heat absorber. This configuration can reduce the occurrence of excessive cooling capability in the utilization unit to reduce the occurrence of dew condensation at the utilization unit and freezing at the utilization heat exchanger.

The heat source unit using the liquid fluid as a heat source is likely to have increase in casing internal temperature due to heat generated from equipment such as the compressor and electric components during operation of the refrigeration apparatus. In other words, the casing often has relatively high internal temperature. In contrast, the present configuration achieves suppression of excessive cooling capability of the utilization unit as well as suppression of excessive increase in casing internal temperature by means of the second heat exchanger functioning as a heat absorber. Particularly in a case where the heat source unit is installed in a room like a machine chamber, air warmed in the casing blows into the machine chamber that also has temperature increase to adversely affect a work environment and the like for a worker in the machine chamber. The second heat exchanger operating as a heat absorber can reduce the occurrence of such problems.

A refrigeration apparatus according to a second aspect of the present invention is the refrigeration apparatus according to the first aspect, in which the compressor has variable capacity. The controller opens the valve to supply the second heat exchanger with the refrigerant to cause the second heat exchanger to function as a heat absorber when assessing that the refrigerant sent to the utilization unit needs to be further decreased in quantity after the capacity of the compressor is decreased to predetermined capacity during the cooling operation in which the first heat exchanger functions as a radiator.

According to this aspect, the capacity of the compressor is initially decreased to the predetermined capacity. This configuration can energetically efficiently reduce the occurrence of excessive cooling capability to reduce the occurrence of dew condensation at the utilization unit and freezing at the utilization heat exchanger.

A refrigeration apparatus according to a third aspect of the present invention is the refrigeration apparatus according to the first aspect or the second aspect, in which the controller assesses that the refrigerant sent to the utilization unit needs to be decreased in quantity when low pressure in a refrigeration cycle decreases to become equal to or less than a predetermined threshold or when the low pressure in the refrigeration cycle is assessed to decrease to become equal to or less than the predetermined threshold.

According to this aspect, the second heat exchanger is supplied with the refrigerant to function as a heat absorber when the low pressure (suction pressure) in the refrigeration cycle becomes or is expected to become equal to or less than the predetermined threshold. This configuration can reduce the occurrence of excessive cooling capability of the utilization unit to reduce the occurrence of dew condensation at the utilization unit and freezing at the utilization heat exchanger.

A refrigeration apparatus according to a fourth aspect of the present invention is the refrigeration apparatus according to any one of the first to third aspects, in which the controller assesses whether or not the refrigerant sent to the utilization unit needs to be decreased in quantity in accordance with a state of the utilization unit.

According to this aspect, whether or not to supply the second heat exchanger with the refrigerant is determined in accordance with the state of the utilization unit. This configuration can thus easily reduce the occurrence of excessive cooling capability of the utilization unit to reduce the occurrence the occurrence of dew condensation at the utilization unit and freezing at the utilization heat exchanger.

A refrigeration apparatus according to a fifth aspect of the present invention is the refrigeration apparatus according to the fourth aspect, further including a temperature measurement unit that measures temperature of the refrigerant flowing in the utilization heat exchanger. The controller assesses whether or not the refrigerant sent to the utilization unit needs to be decreased in quantity in accordance with the temperature measured by the temperature measurement unit.

According to this aspect, whether or not to supply the second heat exchanger with the refrigerant is determined in accordance with the temperature of the refrigerant flowing in the utilization heat exchanger. This configuration can thus easily reduces the occurrence of excessive cooling capability of the utilization unit to reduce the occurrence of dew condensation at the utilization unit and freezing at the utilization heat exchanger.

A refrigeration apparatus according to a sixth aspect of the present invention is the refrigeration apparatus according to the fourth aspect, further including a space temperature measurement unit and a storage unit. The space temperature measurement unit measures temperature in a temperature adjustment target space of the utilization unit. The storage unit stores target temperature in the temperature adjustment target space of the utilization unit. The controller assesses whether or not the refrigerant sent to the utilization unit needs to be decreased in quantity in accordance with the temperature in the space measured by the space temperature measurement unit and the target temperature in the space stored in the storage unit.

According to this aspect, whether or not to supply the second heat exchanger with the refrigerant is determined in accordance with the temperature in the cooling target space of the utilization unit and the target temperature. This configuration can thus easily reduce the occurrence of excessive cooling capability of the utilization unit to reduce the occurrence of dew condensation at the utilization unit and freezing at the utilization heat exchanger.

A refrigeration apparatus according to a seventh aspect of the present invention is the refrigeration apparatus according to any one of the first to sixth aspects, further including a bypass pipe and a bypass valve. The bypass pipe connects a suction tube and a discharge tube of the compressor. The bypass valve is provided on the bypass pipe. The controller further controls operation of the bypass valve. The controller controls to open the bypass valve when assessing that the refrigerant sent to the utilization unit needs to be further decreased in quantity after the second heat exchanger functions as a heat absorber during the cooling operation.

According to this aspect, the refrigerant sent to the utilization unit can be further decreased in quantity by causing the refrigerant discharged from the compressor to partially pass through the bypass pipe when the cooling capability is still excessive even when the second heat exchanger operates.

A refrigeration apparatus according to an eighth aspect of the present invention is the refrigeration apparatus according to any one of the first to seventh aspects, further including a casing internal temperature measurement unit that measures temperature in the casing. The controller opens the valve to supply the second heat exchanger with the refrigerant to cause the second heat exchanger to function as a heat absorber when assessing that the refrigerant sent to the utilization unit needs to be decreased in quantity and the temperature in the casing measured by the casing internal temperature measurement unit is higher than first predetermined temperature.

According to this aspect, the second heat exchanger is supplied with the refrigerant when it is assessed that the refrigerant sent to the utilization unit needs to be decreased in quantity and also the temperature in the casing is higher than the first predetermined temperature. This configuration achieves a high reliable refrigeration apparatus that controls not to supply the second heat exchanger with the refrigerant when the temperature in the casing is low and there is a possibility that a refrigerant in a wet state is sent to the compressor from the second heat exchanger and liquid compression is therefore be caused.

A refrigeration apparatus according to a ninth aspect of the present invention is the refrigeration apparatus according to any one of the first to eighth aspects, further including a casing internal temperature measurement unit configured to measure temperature in the casing. The controller has a casing interior cooling mode as a selectively adoptable operating mode. In the casing interior cooling mode, the controller opens the valve to supply the second heat exchanger with the refrigerant to cause the second heat exchanger to function as a heat absorber when the temperature in the casing measured by the casing internal temperature measurement unit is higher than second predetermined temperature. The controller opens the valve to supply the second heat exchanger with the refrigerant to cause the second heat exchanger to function as a heat absorber when assessing that the refrigerant sent to the utilization unit needs to be decreased in quantity during the cooling operation, even when the casing interior cooling mode is not selected as an operating mode to be adopted.

According to this aspect, even when the casing interior cooling mode is not selected as the operating mode, the refrigeration apparatus operates to cause the second heat exchanger function as a heat absorber to achieve protective control of inhibiting dew condensation at the utilization unit and freezing at the utilization heat exchanger. The refrigeration apparatus thus achieves high reliability.

A refrigeration apparatus according to a tenth aspect of the present invention is the refrigeration apparatus according to the ninth aspect, in which the controller opens the valve to supply the second heat exchanger with the refrigerant to cause the second heat exchanger to function as a heat absorber when assessing that the refrigerant sent to the utilization unit needs to be decreased in quantity during the cooling operation and the casing interior cooling mode being selected as the operating mode to be adopted, even when the temperature in the casing measured by the casing internal temperature measurement unit is lower than the second predetermined temperature.

According to this aspect, even when not satisfying a condition for executing the casing interior cooling mode, the refrigeration apparatus operates with the second heat exchanger functioning as a heat absorber to achieve protective control of inhibiting dew condensation at the utilization unit and freezing at the utilization heat exchanger. The refrigeration apparatus thus achieves high reliability.

A refrigeration apparatus according to an eleventh aspect of the present invention is the refrigeration apparatus according to the second aspect, in which the predetermined capacity is minimum capacity of the compressor.

According to this aspect, even when the compressor cannot be further decreased in capacity, it is possible to reduce the occurrence of excessive cooling capability of the utilization unit to reduce the occurrence of dew condensation at the utilization unit and freezing at the utilization heat exchanger by functioning the second heat exchanger as a heat absorber.

Advantageous Effects of Invention

In the refrigeration apparatus according to the first aspect of the present invention, when the refrigerant sent from the heat source unit to the utilization unit needs to be decreased in quantity during operation in which the first heat exchanger (liquid fluid heat exchanger) functions as a radiator, the refrigerant is sent to the second heat exchanger (air heat exchanger) to cause the second heat exchanger to function as a heat absorber. This configuration can reduce the occurrence of excessive cooling capability in the utilization unit to reduce the occurrence of dew condensation at the utilization unit and freezing at the utilization heat exchanger.

The refrigeration apparatus according to the second aspect of the present invention can energetically efficiently reduce the occurrence of excessive cooling capability to reduce the occurrence of dew condensation at the utilization unit and freezing at the utilization heat exchanger.

The refrigeration apparatus according to the third aspect of the present invention can reduce the occurrence of excessive cooling capability of the utilization unit to reduce the occurrence of dew condensation at the utilization unit and freezing at the utilization heat exchanger.

The refrigeration apparatus according to any one of the fourth to sixth aspects of the present invention can easily reduce the occurrence of excessive cooling capability of the utilization unit and reduce the occurrence of dew condensation at the utilization unit and freezing at the utilization heat exchanger.

The refrigeration apparatus according to the seventh aspect of the present invention achieves further decrease in quantity of the refrigerant sent to the utilization unit.

The refrigeration apparatus according to any one of the eighth to tenth aspects of the present invention achieves high reliability.

The refrigeration apparatus according to the eleventh aspect of the present invention can reduce the occurrence of dew condensation at the utilization unit and freezing at the utilization heat exchanger even when the compressor cannot be further decreased in capacity.

DESCRIPTION OF EMBODIMENTS

A refrigeration apparatus according to an embodiment of the present invention will be described hereinafter with reference to the drawings. The embodiment and modification examples to be described hereinafter merely exemplify the present invention without limiting the technical scope of the present invention, and can be appropriately modified within the range not departing from the purpose of the present invention.

(1) ENTIRE CONFIGURATION

Figure 1:
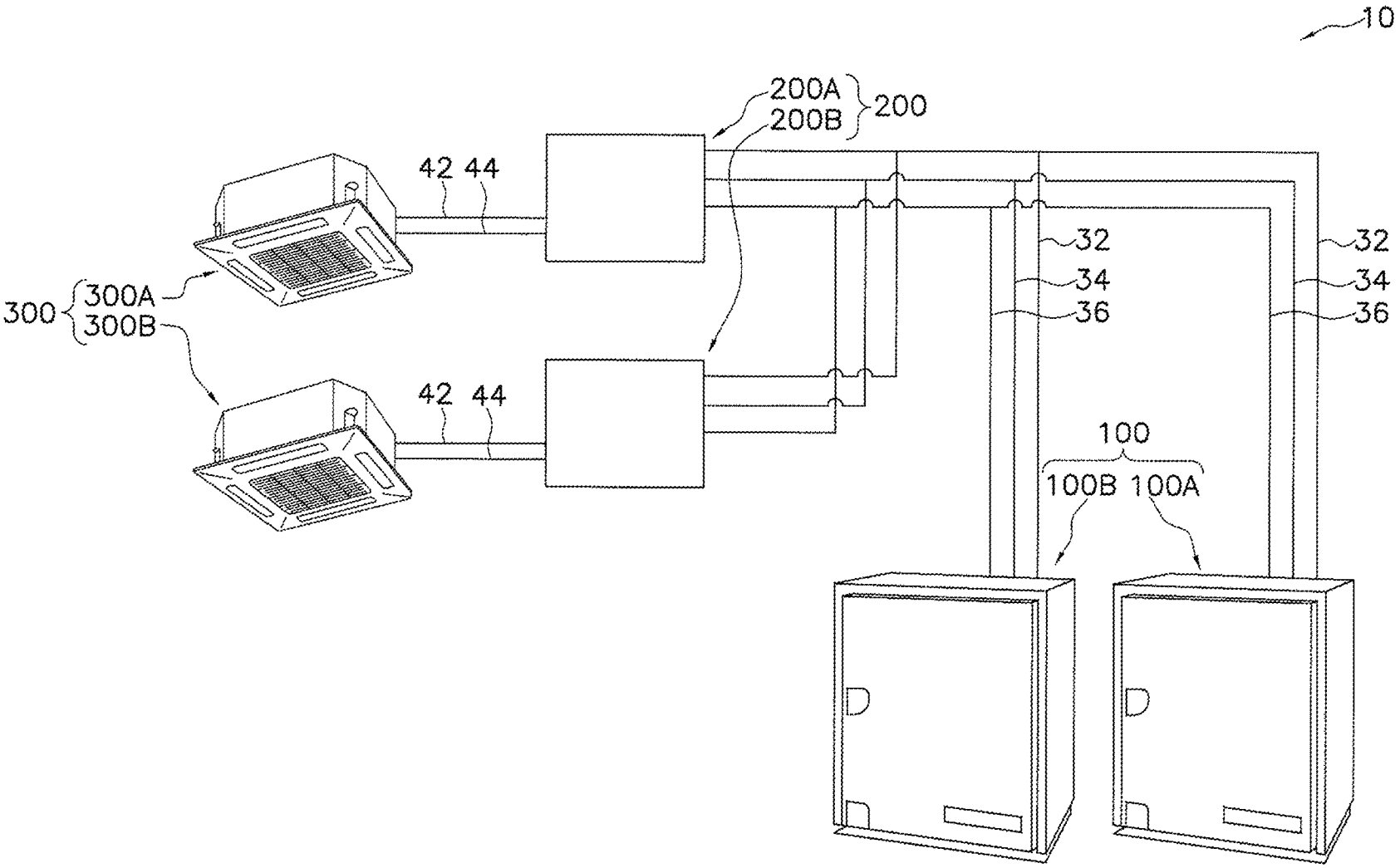
FIG. 1 is a schematic block diagram of an air conditioner as a refrigeration apparatus according to an embodiment of the present invention.
Figure 2:
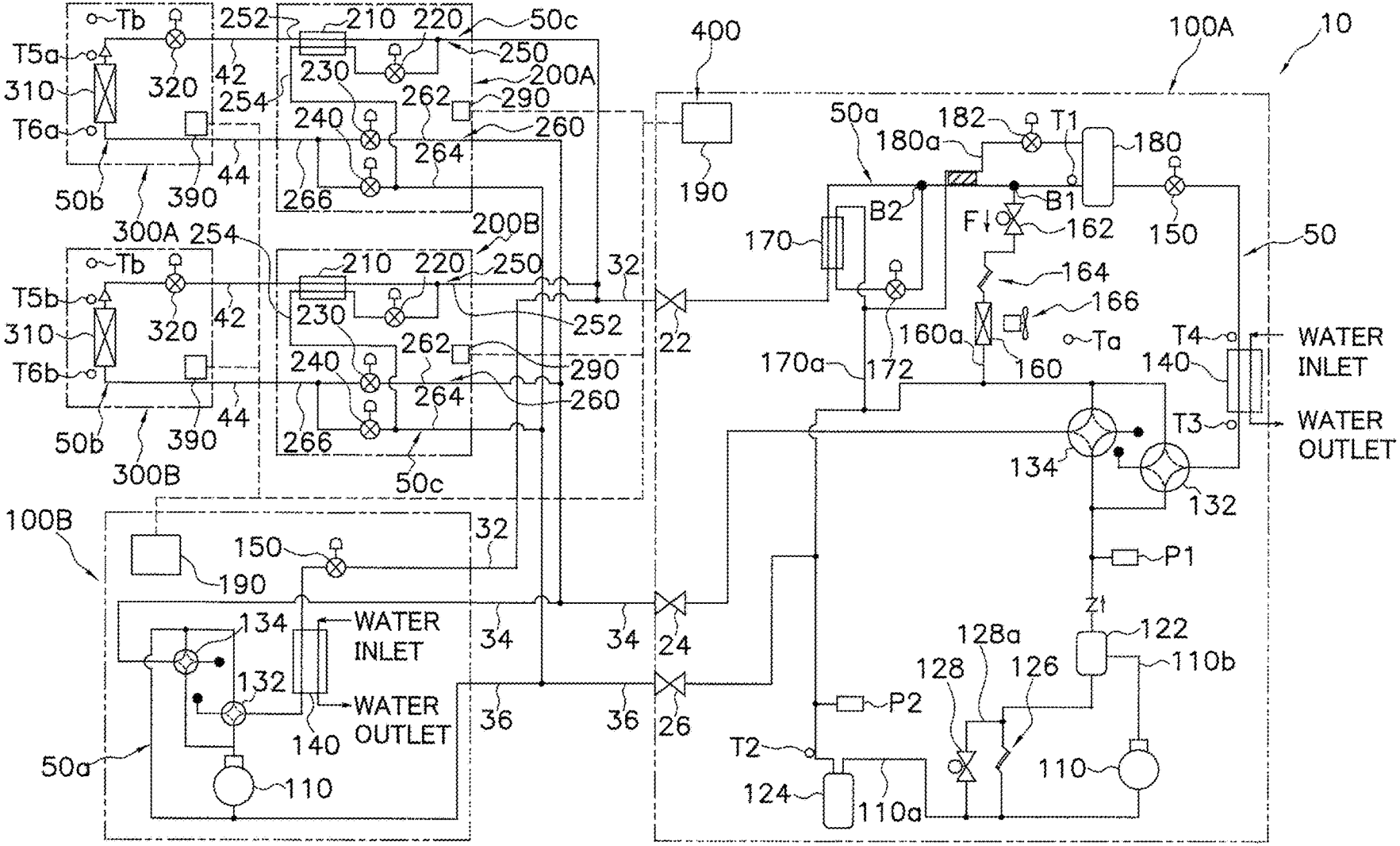
FIG. 2 is a schematic refrigerant circuit diagram of the air conditioner depicted in FIG. 1.

FIG. 1 is a schematic configuration diagram of an air conditioner 10 as the refrigeration apparatus according to the embodiment of the present invention. FIG. 2 is a schematic refrigerant circuit diagram of the air conditioner 10.

FIG. 2 depicts only part of constituents in a heat source unit 100B for simplified depiction. The actual heat source unit 100B has a configuration being to a heat source unit 100A.

The air conditioner 10 is configured to execute vapor-compression refrigeration cycle operation to cool or heat a target space (e.g. a room in a building). The refrigeration apparatus according to the present invention is not limited to the air conditioner but may alternatively be configured as a refrigerator, a freezer, or the like.

The air conditioner 10 mainly includes a plurality of heat source units 100 (100A and 100B), a plurality of utilization units 300 (300A and 300B), a plurality of connection units 200 (200A and 200B), refrigerant connection pipes 32, 34, and 36, and connecting pipes 42 and 44 (see FIG. 1). The connection unit 200A is configured to switch a flow of a refrigerant to the utilization unit 300A. The connection unit 200B is configured to switch a flow of the refrigerant to the utilization unit 300B. The refrigerant connection pipes 32, 34, and 36 are refrigerant pipes connecting the heat source units 100 and the connection units 200. The refrigerant connection pipes 32, 34, and 36 include a liquid-refrigerant connection pipe 32, a high and low-pressure gas-refrigerant connection pipe 34, and a low-pressure gas-refrigerant connection pipe 36. The connecting pipes 42 and 44 are refrigerant pipes connecting the connection unit 200 and the utilization unit 300. The connecting pipes 42 and 44 include a liquid connecting pipe 42 and a gas connecting pipe 44.

The numbers (two each) of the heat source units 100, the utilization units 300, and the connection units 200 depicted in FIG. 1 are merely exemplified and should not limit the present invention. For example, there may be provided one or at least three heat source units. Furthermore, there may be provided one or at least three (e.g. a large number such as ten or more) utilization units or connection units. Here, each of the utilization units is individually provided with the single connection unit. The present invention should not be limited to this configuration, but the plurality of connection units to be described below may be collected to constitute a single unit.

Each of the utilization units 300 in the present air conditioner 10 is configured to execute cooling operation or heating operation independently from the remaining utilization unit 300. In other words, in the present air conditioner 10, while part of the utilization units (e.g. the utilization unit 300A) is executing cooling operation for cooling an air conditioning target space corresponding to these utilization units, the remaining utilization unit (e.g. the utilization unit 300B) can execute heating operation for heating an air conditioning target space corresponding to those utilization units. In the present air conditioner 10, the utilization unit 300 executing heating operation sends the refrigerant to the utilization unit 300 executing cooling operation to achieve heat recovery between the utilization units 300. The air conditioner 10 is configured to balance thermal loads of the heat source units 100 in accordance with the entire thermal loads of the utilization units 300 also in consideration of the heat recovery.

(2) DETAILED CONFIGURATIONS

(2-1) Heat Source Unit

The heat source unit 100A will be described with reference to FIGS. 2 to 4. The heat source unit 100B has a configuration being similar to the heat source unit 100A. The heat source unit 100B will not be described herein to avoid repeated description.

FIG. 2 depicts only part of constituents in the heat source unit 100B for simplified depiction. The actual heat source unit 100B has a configuration being similar to the heat source unit 100A.

The heat source unit 100A is installed in a machine chamber (the interior of a room) of the building provided with the air conditioner 10, though not limited in terms of its installation site. The heat source unit 100A may alternatively be disposed outdoors.

The heat source unit 100A according to the present embodiment utilizes water as a heat source. In the heat source unit 100A, heat is exchanged between the refrigerant and water circulating in a water circuit (not depicted) to heat or cool the refrigerant. The heat source of the heat source unit 100A is not limited to water, but may alternatively be any other liquid heating medium (e.g. a thermal-storage medium such as brine or hydrate slurry).

The heat source unit 100A is connected to the utilization units 300 via the refrigerant connection pipes 32, 34, and 36, the connection units 200, and the connecting pipes 42 and 44. The heat source unit 100A and the utilization units 300 constitute a refrigerant circuit 50 (see FIG. 2). The refrigerant circulates in the refrigerant circuit 50 while the air conditioner 10 is in operation.

The refrigerant adopted in the present embodiment is a substance that absorbs peripheral heat in a liquid state to come into a gaseous state and radiates heat to the periphery in the gaseous state to come into the liquid state in the refrigerant circuit 50. Examples of the refrigerant include a fluorocarbon refrigerant, though not limited in terms of its type.

As depicted in FIG. 2, the heat source unit 100A mainly includes a heat source-side refrigerant circuit 50*a* constituting part of the refrigerant circuit 50. The heat source-side refrigerant circuit 50*a* includes a compressor 110, a heat source-side heat exchanger 140 exemplifying a main heat exchanger, and a heat source-side flow-rate control valve 150. The heat source-side refrigerant circuit 50*a* also includes a first flow path switching mechanism 132 and a second flow path switching mechanism 134. The heat source-side refrigerant circuit 50*a* further includes an oil separator 122 and an accumulator 124. The heat source-side refrigerant circuit 50*a* further includes a receiver 180 and a gas vent pipe flow-rate control valve 182. The heat source-side refrigerant circuit 50*a* further includes a subcooling heat exchanger 170 and a second suction return valve 172. The heat source-side refrigerant circuit 50*a* further includes a cooling heat exchanger 160, a first suction return valve 162, and a capillary 164. The heat source-side refrigerant circuit 50*a* further includes a bypass valve 128. The heat source-side refrigerant circuit 50*a* further includes a liquid-side shutoff valve 22, a high and low-pressure gas-side shutoff valve 24, and a low-pressure gas-side shutoff valve 26.

Figure 3:
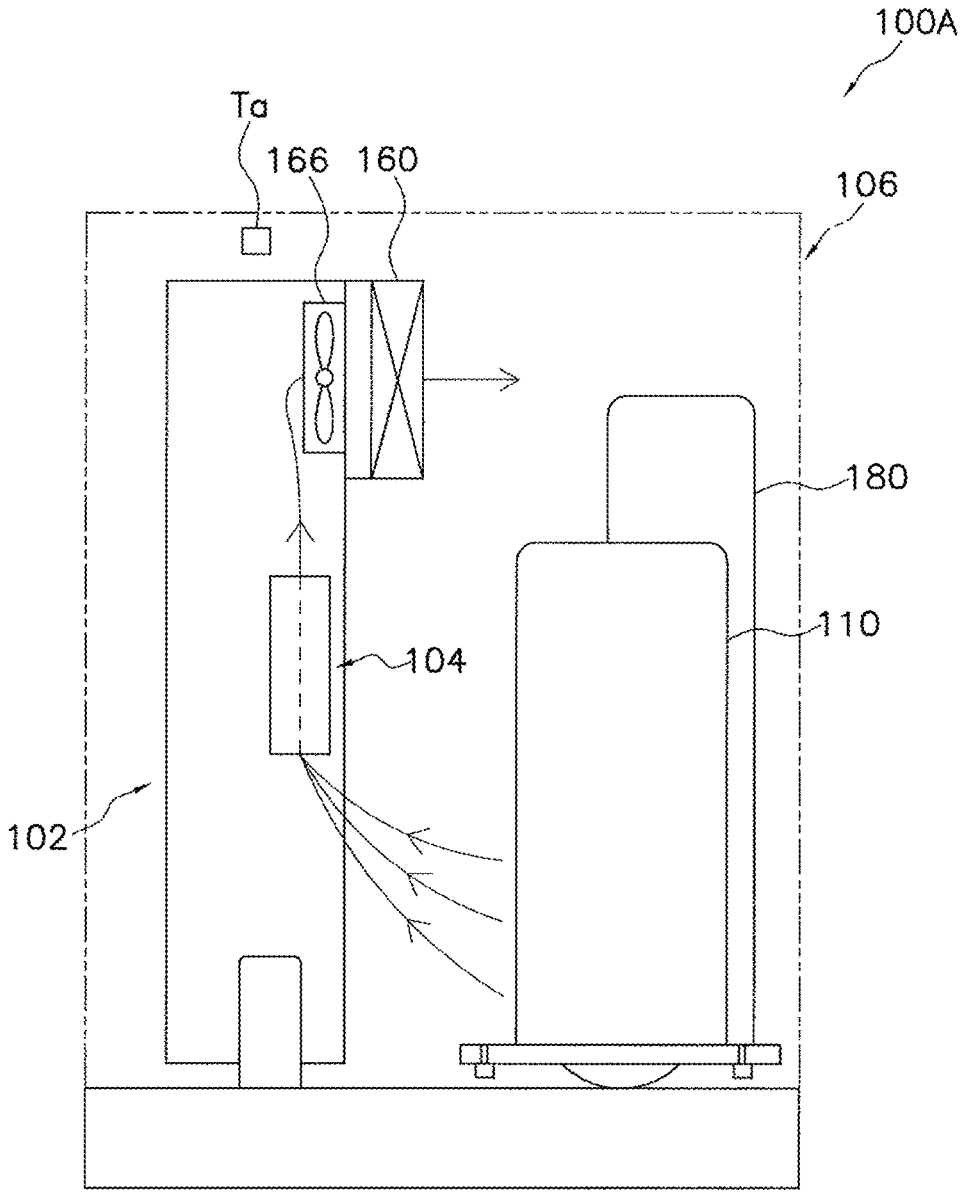
FIG. 3 is a schematic side view of the interior of a heat source unit included in the air conditioner depicted in FIG. 1.
Figure 4:
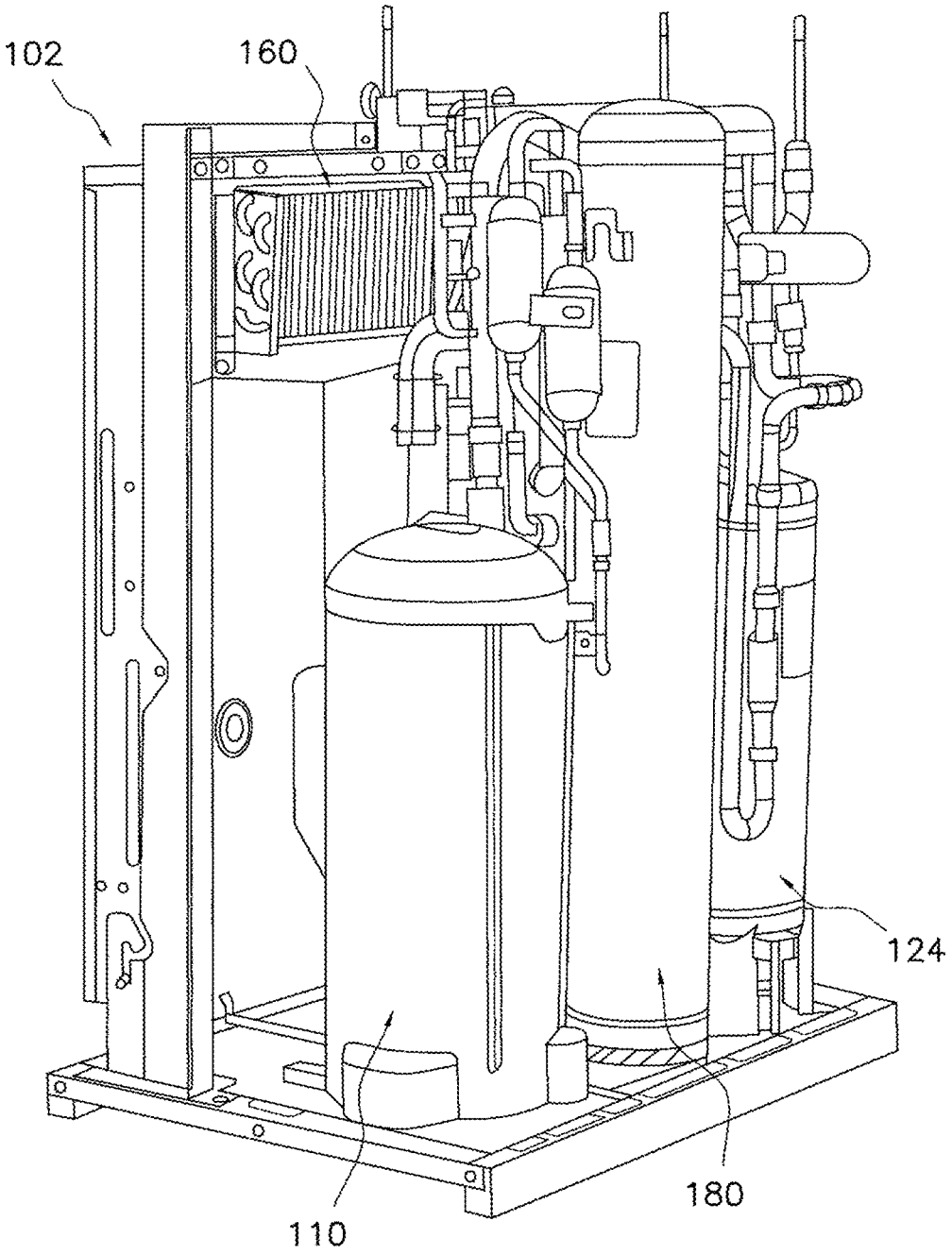
FIG. 4 is a schematic perspective view of the interior of the heat source unit in the air conditioner depicted in FIG. 1.

The heat source unit 100A includes a casing 106, an electric component box 102, a fan 166, pressure sensors P1 and P2, temperature sensors T1, T2, T3, T4, and Ta, and a heat source unit controller 190 (see FIG. 2 and FIG. 3). The casing 106 is a housing accommodating various constituent equipment of the heat source unit 100A, such as the compressor 110, the heat source-side heat exchanger 140, and the cooling heat exchanger 160.

Such various constituents of the heat source-side refrigerant circuit 50*a*, the electric component box 102, the fan 166, the pressure sensors P1 and P2, the temperature sensors T1, T2, T3, T4, and Ta, and the heat source unit controller 190 will be described in more detail below.

(2-1-1) Heat Source-Side Refrigerant Circuit (2-1-1-1) Compressor

The compressor 110 is of a positive-displacement type such as a scroll type or a rotary type, though not limited in terms of its type. The compressor 110 has a hermetic structure incorporating a compressor motor (not depicted). The compressor 110 is configured to vary operating capacity through inverter control of the compressor motor.

The compressor 110 has a suction port (not depicted) connected to a suction pipe 110*a* (see FIG. 2). The compressor 110 compresses a low-pressure refrigerant sucked via the suction port, and then discharges the compressed refrigerant from a discharge port (not depicted). The discharge port of the compressor 110 is connected to a discharge pipe 110*b* (see FIG. 2).

(2-1-1-2) Oil Separator

The oil separator 122 separates lubricant from gas discharged from the compressor 110. The oil separator 122 is provided at the discharge pipe 110*b*. The lubricant separated by the oil separator 122 returns to a suction side (the suction pipe 110*a*) of the compressor 110 via the capillary 126 (see FIG. 2).

(2-1-1-3) Accumulator

The accumulator 124 is provided at the suction pipe 110*a* (see FIG. 2). The accumulator 124 is a reservoir temporarily storing a low-pressure refrigerant to be sucked into the compressor 110 and performing gas-liquid separation. In the accumulator 124, a refrigerant in a gas-liquid two-phase state is separated into a gas refrigerant and a liquid refrigerant, and the compressor 110 receives mainly the gas refrigerant.

(2-1-1-4) First Flow Path Switching Mechanism

The first flow path switching mechanism 132 is configured to switch a flow direction of a refrigerant flowing in the heat source-side refrigerant circuit 50*a*. The first flow path switching mechanism 132 is exemplarily constituted by a four-way switching valve as depicted in FIG. 2. The four-way switching valve adopted as the first flow path switching mechanism 132 is configured to block a flow of a refrigerant in one refrigerant flow path to substantially function as a three-way valve.

In a case where the heat source-side heat exchanger 140 functions as a radiator (condenser) for a refrigerant flowing in the heat source-side refrigerant circuit 50*a* (hereinafter, also called a "radiating operation state"), the first flow path switching mechanism 132 connects a discharge side (the discharge pipe 110*b*) of the compressor 110 and a gas side of the heat source-side heat exchanger 140 (see a solid line in the first flow path switching mechanism 132 in FIG. 2). In another case where the heat source-side heat exchanger 140 functions as a heat absorber (evaporator) for a refrigerant flowing in the heat source-side refrigerant circuit 50*a* (hereinafter, also called a "heat absorbing operation state"), the first flow path switching mechanism 132 connects the suction pipe 110*a* and the gas side of the heat source-side heat exchanger 140 (see a broken line in the first flow path switching mechanism 132 in FIG. 2).

(2-1-1-5) Second Flow Path Switching Mechanism

The second flow path switching mechanism 134 is configured to switch a flow direction of a refrigerant flowing in the heat source-side refrigerant circuit 50*a*. The second flow path switching mechanism 134 is exemplarily constituted by a four-way switching valve as depicted in FIG. 2. The four-way switching valve adopted as the second flow path switching mechanism 134 is configured to block a flow of a refrigerant in one refrigerant flow path to substantially function as a three-way valve.

In a case where a high-pressure gas refrigerant discharged from the compressor 110 is sent to the high and low-pressure gas-refrigerant connection pipe 34 (hereinafter, also called a "radiation load operation state"), the second flow path switching mechanism 134 connects the discharge side (the discharge pipe 110*b*) of the compressor 110 and the high and low-pressure gas-side shutoff valve 24 (see a broken line in the second flow path switching mechanism 134 in FIG. 2). In another case where the high-pressure gas refrigerant discharged from the compressor 110 is not sent to the high and low-pressure gas-refrigerant connection pipe 34 (hereinafter, also called an "evaporation load operation state"), the second flow path switching mechanism 134 connects the high and low-pressure gas-side shutoff valve 24 and the suction pipe 110*a* of the compressor 110 (see a solid line in the second flow path switching mechanism 134 in FIG. 2).

(2-1-1-6) Heat Source-Side Heat Exchanger

The heat source-side heat exchanger 140 exemplifying a first heat exchanger causes heat exchange between the refrigerant and liquid fluid as the heat source (cooling water or warm water circulating in the water circuit in the present embodiment). Such liquid fluid is not controlled at the air conditioner 10 in terms of its temperature and its flow rate, although the present invention is not limited to such a configuration. The heat source-side heat exchanger 140 is exemplarily configured as a plate heat exchanger. The heat source-side heat exchanger 140 has the gas side for the refrigerant connected to the first flow path switching mechanism 132 via a pipe, and also has the liquid side for the refrigerant connected to the heat source-side flow-rate control valve 150 via a pipe (see FIG. 2).

(2-1-1-7) Heat Source-Side Flow-Rate Control Valve

The heat source-side flow-rate control valve 150 is configured to control a flow rate of a refrigerant flowing in the heat source-side heat exchanger 140. The heat source-side flow-rate control valve 150 is provided at the liquid side (on a pipe connecting the heat source-side heat exchanger 140 and the liquid-side shutoff valve 22) of the heat source-side heat exchanger 140 (see FIG. 2). In other words, the heat source-side flow-rate control valve 150 is provided on a pipe connecting the heat source-side heat exchanger 140 and utilization heat exchangers 310 in the utilization units 300. The heat source-side flow-rate control valve 150 is exemplarily configured as an electric expansion valve having a controllable opening degree.

(2-1-1-8) Receiver and Gas Vent Pipe Flow-Rate Control Valve

The receiver 180 is a reservoir temporarily storing a refrigerant flowing between the heat source-side heat exchanger 140 and the utilization units 300. The receiver 180 is disposed between the heat source-side flow-rate control valve 150 and the liquid-side shutoff valve 22, on a pipe connecting the liquid side of the heat source-side heat exchanger 140 and the utilization units 300 (see FIG. 2). The receiver 180 has a top portion connected to a receiver gas vent pipe 180*a* (see FIG. 2). The receiver gas vent pipe 180*a* connects the top portion of the receiver 180 and the suction side of the compressor 110.

The receiver gas vent pipe 180*a* is provided with the gas vent pipe flow-rate control valve 182 configured to control a flow rate of a refrigerant to be subjected to gas venting from the receiver 180. The gas vent pipe flow-rate control valve 182 is exemplarily configured as an electric expansion valve having a controllable opening degree.

(2-1-1-9) Cooling Heat Exchanger and First Suction Return Valve

The heat source-side refrigerant circuit 50*a* is provided with a first suction return pipe 160*a* branching at a branching point B1 from a pipe connecting the receiver 180 and the liquid-side shutoff valve 22 and connected to the suction side (the suction pipe 110*a*) of the compressor 110 (see FIG. 2). The first suction return pipe 160*a* connects the pipe connecting between the heat source-side heat exchanger 140 and the utilization heat exchangers 310 in the utilization units 300 and the suction pipe 110*a* of the compressor 110.

The first suction return pipe 160*a* is provided with the cooling heat exchanger 160 exemplifying a second heat exchanger, the first suction return valve 162, and the capillary 164 (see FIG. 2). The first suction return valve 162 exemplifies a valve.

The cooling heat exchanger 160 is configured to cause heat exchange between a refrigerant flowing in the cooling heat exchanger 160 and air. The cooling heat exchanger 160 is exemplarily of a cross-fin type, though not limited in terms of its type. The cooling heat exchanger 160 is supplied with air by the fan 166 to be described later for stimulated heat exchange between the refrigerant and the air.

The cooling heat exchanger 160 has two main functions.

Firstly, the cooling heat exchanger 160 functions as a heat absorber when it is assessed that the refrigerant sent to the utilization unit 300 needs to be decreased in quantity during cooling operation in which the heat source-side heat exchanger 140 functions as a radiator. Particularly, in the present embodiment, the cooling heat exchanger 160 functions as a heat absorber when it is assessed that the refrigerant sent to the utilization unit 300 needs to be further decreased in quantity after the capacity of the compressor 110 is decreased to predetermined capacity during cooling operation in which the heat source-side heat exchanger 140 functions as a radiator. This configuration can reduce the occurrence of excessive cooling capability of the utilization unit 300 to reduce the occurrence of dew condensation at the utilization unit 300 and freezing at the utilization heat exchanger 310.

The cooling heat exchanger 160 has the second function of cooling the interior of the casing 106 of the heat source unit 100A by means of a supplied refrigerant.

The first suction return valve 162 switches to supply or not to supply the cooling heat exchanger 160 with a refrigerant. The capillary 164 is disposed downstream of the first suction return valve 162 in a refrigerant flow direction F (see FIG. 2) of the refrigerant flowing to the cooling heat exchanger 160 when the first suction return valve 162 is opened. The refrigerant flow direction F is a direction from the branching point B1 toward the suction side (the suction pipe 110*a*) of the compressor 110. The capillary 164 may alternatively be disposed upstream of the first suction return valve 162 in the refrigerant flow direction F.

The first suction return pipe 160*a* may be provided with an electric expansion valve having a controllable opening degree, in place of the first suction return valve 162 and the capillary 164.

(2-1-1-10) Subcooling Heat Exchanger and Suction Return Flow-Rate Control Valve

The heat source-side refrigerant circuit 50*a* is provided with a second suction return pipe 170*a* branching at a branching point B2 from the pipe connecting the receiver 180 and the liquid-side shutoff valve 22 and connected to the suction side (the suction pipe 110*a*) of the compressor 110 (see FIG. 2). The second suction return pipe 170*a* is provided with the second suction return valve 172 (see FIG. 2). The second suction return valve 172 is exemplarily configured as an electric expansion valve having a controllable opening degree.

The subcooling heat exchanger 170 is provided on the pipe connecting the receiver 180 and the liquid-side shutoff valve 22, at a position shifted from the branching point B2 toward the liquid-side shutoff valve 22. The subcooling heat exchanger 170 causes heat exchange between the refrigerant flowing through the pipe connecting the receiver 180 and the liquid-side shutoff valve 22 and the refrigerant flowing through the second suction return pipe 170*a* to cool the refrigerant flowing through the pipe connecting the receiver 180 and the liquid-side shutoff valve 22. The subcooling heat exchanger 170 is exemplarily configured as a double pipe heat exchanger.

(2-1-1-11) Bypass Valve

The bypass valve 128 is provided on a bypass pipe 128*a* connecting the discharge pipe 110*b* (the oil separator 122 provided on the discharge pipe 110*b* herein) of the compressor 110 and the suction pipe 110*a* of the compressor 110 (see FIG. 2). The bypass valve 128 is configured as an electromagnetic valve controlled to open and close. When the bypass valve 128 is controlled to open, the refrigerant discharged from the compressor 110 partially flows into the suction pipe 110*a*.

The bypass valve 128 is appropriately controlled to open or close in accordance with an operation situation of the air conditioner 10. In a case where the compressor motor is inverter controlled to reduce the operating capacity of the compressor 110 and the operating capacity thus reduced is still excessive, the bypass valve 128 may be opened to reduce quantity of the refrigerant circulating in the refrigerant circuit 50. Specifically, for example, the bypass valve 128 is controlled to open when it is assessed that the refrigerant sent to the utilization unit 300 needs to be decreased in quantity during cooling operation in which the heat source-side heat exchanger 140 functions as a radiator.

The bypass valve 128 may be opened at predetermined timing to increase a degree of superheating on the suction side of the compressor 110 for reducing the occurrence of liquid compression.

(2-1-1-12) Liquid-Side Shutoff Valve, High and Low-Pressure Gas-Side Shutoff Valve, and Low-Pressure Gas-Side Shutoff Valve The liquid-side shutoff valve 22, the high and low-pressure gas-side shutoff valve 24, and the low-pressure gas-side shutoff valve 26 are manually operated to open or close upon refrigerant filling, pump down, and the like.

The liquid-side shutoff valve 22 has a first end connected to the liquid-refrigerant connection pipe 32 and a second end connected to a refrigerant pipe extending toward the heat source-side flow-rate control valve 150 via the receiver 180 (see FIG. 2).

The high and low-pressure gas-side shutoff valve 24 has a first end connected to the high and low-pressure gas-refrigerant connection pipe 34 and a second end connected to a refrigerant pipe extending to the second flow path switching mechanism 134 (see FIG. 2).

The low-pressure gas-side shutoff valve 26 has a first end connected to the low-pressure gas-refrigerant connection pipe 36 and a second end connected to a refrigerant pipe extending to the suction pipe 110*a* (see FIG. 2).

(2-1-2) Electric Component Box and Fan

The casing 106 of the heat source unit 100A accommodates the electric component box 102. The electric component box 102 has a rectangular parallelepiped shape, though not limited in terms of its shape. The electric component box 102 accommodates electric components 104 configured to control operation of the various constituents, such as the compressor 110, the flow path switching mechanisms 132 and 134, and the valves 150, 182, 172, 162, and 128, in the heat source unit 100A in the air conditioner 10 (see FIG. 3). The electric components 104 include electric components constituting an inverter circuit for control of the motor of the compressor 110, as well as electric components such as a microcomputer and a memory constituting the heat source unit controller 190 to be described later.

The electric component box 102 has a lower opening (not depicted) allowing air to enter the electric component box 102, and an upper opening (not depicted) allowing air to blow out of the electric component box 102. The fan 166 is provided adjacent to the upper opening (see FIG. 3). The fan 166 is provided, on an air blow-out side (downstream in an air blow-out direction), with the cooling heat exchanger 160 (see FIG. 3 and FIG. 4). When the fan 166 operates, air flowed into the electric component box 102 through the lower opening moves upward in the electric component box 102 and blows out of the electric component box 102 through the upper opening. When the air moves in the electric component box 102, the air moving in the electric component box 102 cools the electric components 104. Air absorbed heat from the electric components 104 and thus warmed blows out of the electric component box 102 into the casing 106 through the upper opening. The present air conditioner 10 includes the fan 166 configured as a constant-speed fan. The fan 166 may alternatively be a variable speed fan.

The casing 106 has a suction opening (not depicted) disposed in a lower portion of a side surface, and an exhaust opening (not depicted) disposed in a top portion, to allow ventilation in the casing 106 with air from outside the casing 106. The interior of the casing 106 is increased in temperature in a case where the ventilation is insufficient relatively to heat generated by the electric components 104, the motor of the compressor 110, and the like, or in a case where the casing 106 has relatively high ambient temperature.

(2-1-3) Pressure Sensor

The heat source unit 100A includes the plurality of pressure sensors configured to measure pressure of a refrigerant. The pressure sensors include the high pressure sensor P1 and the low pressure sensor P2.

The high pressure sensor P1 is disposed on the discharge pipe 110*b* (see FIG. 2). The high pressure sensor P1 measures pressure of a refrigerant discharged from the compressor 110. In other words, the high pressure sensor P1 measures high pressure in the refrigeration cycle.

The low pressure sensor P2 is disposed on the suction pipe 110*a* (see FIG. 2). The low pressure sensor P2 measures pressure of a refrigerant sucked into the compressor 110. In other words, the low pressure sensor P2 measures low pressure in the refrigeration cycle.

(2-1-4) Temperature Sensor

The heat source unit 100A includes the plurality of temperature sensors configured to measure temperature of a refrigerant.

The temperature sensors configured to measure temperature of a refrigerant may include the liquid-refrigerant temperature sensor T1 provided on the pipe connecting the receiver 180 and the liquid-side shutoff valve 22, at a position shifted from the branching point B1, where the first suction return pipe 160*a* branches, toward the receiver 180 (see FIG. 2). The temperature sensors configured to measure temperature of a refrigerant may also include the sucked refrigerant temperature sensor T2 provided upstream of the accumulator 124, on the suction pipe 110*a* (see FIG. 2). The temperature sensors configured to measure temperature of a refrigerant also include the gas-side temperature sensor T3 provided on the gas side of the heat source-side heat exchanger 140, and the liquid-side temperature sensor T4 provided on the liquid side of the heat source-side heat exchanger 140 (see FIG. 2). The temperature sensors configured to measure temperature of a refrigerant may also include a discharge temperature sensor (not depicted) provided on the discharge pipe 110*b* of the compressor 110. The temperature sensors configured to measure temperature of a refrigerant may also include temperature sensors (not depicted) provided upstream and downstream of the sub-cooling heat exchanger 170 in a refrigerant flow direction of the second suction return pipe 170*a*. The temperature sensors configured to measure temperature of a refrigerant may also include a temperature sensor provided downstream of the cooling heat exchanger 160 in a refrigerant flow direction of the first suction return pipe 160*a*.

The heat source unit 100A includes the casing internal temperature sensor Ta configured to measure temperature in the casing 106. The casing internal temperature sensor Ta exemplifies a casing internal temperature measurement unit. The casing internal temperature sensor Ta is installed adjacent to a ceiling of the casing 106, though not limited in terms of its installation site (see FIG. 3).

(2-1-5) Heat Source Unit Controller

The heat source unit controller 190 includes the microcomputer and the memory provided for control of the heat source unit 100A. The heat source unit controller 190 is electrically connected to the various sensors including the pressure sensors P1 and P2 and the temperature sensors T1, T2, T3, T4, and Ta. FIG. 2 omits depicting connections between the heat source unit controller 190 and the sensors. The heat source unit controller 190 is also electrically connected to connection unit controllers 290 in the connection units 200A and 200B, and utilization unit controllers 390 in the utilization units 300A and 300B, for transmission and reception of control signals to and from the connection unit controllers 290 and the utilization unit controllers 390. The heat source unit controllers 190, the connection unit controllers 290, and the utilization unit controllers 390 operate in cooperation as a control unit 400 configured to control the air conditioner 10. Control of the air conditioner 10 by the control unit 400 will be described later.

(2-2) Utilization Unit

The utilization unit 300A will be described with reference to FIG. 2. The utilization unit 300B is configured similarly to the utilization unit 300A and thus will not be described herein to avoid repeated description.

The utilization unit 300A may be of a ceiling embedded type and be embedded in a ceiling of the room in the building as exemplarily depicted in FIG. 1. The utilization unit 300A should not be limited to the ceiling embedded type, but may alternatively be of a ceiling pendant type, a wall mounted type to be mounted on a wall surface in the room, or the like. The utilization unit 300A and the utilization unit 300B may not be of a same type.

The utilization unit 300A is connected to the heat source units 100 via the connecting pipes 42 and 44, the connection unit 200A, and the refrigerant connection pipes 32, 34, and 36. The utilization unit 300A and the heat source unit 100 constitute the refrigerant circuit 50.

The utilization unit 300A includes a utilization refrigerant circuit 50*b* constituting part of the refrigerant circuit 50. The utilization refrigerant circuit 50*b* mainly includes a utilization flow-rate control valve 320 and the utilization heat exchanger 310. The utilization unit 300A further includes temperature sensors T5*a*, T6*a*, and Tb, and the utilization unit controller 390. The utilization unit 300B includes temperature sensors denoted by reference signs T5*b* and T6*b* in FIG. 2 for convenience of description, but the temperature sensors T5*b* and T6*b* are configured similarly to the temperature sensors T5*a* and T6*a* included in the utilization unit 300A.

(2-2-1) Utilization Refrigerant Circuit (2-2-1-1) Utilization Flow-Rate Control Valve The utilization flow-rate control valve 320 is configured to control a flow rate of a refrigerant flowing in the utilization heat exchanger 310. The utilization flow-rate control valve 320 is provided on a liquid side of the utilization heat exchanger 310 (see FIG. 2). The utilization flow-rate control valve 320 is exemplarily configured as an electric expansion valve having a controllable opening degree.

(2-2-1-2) Utilization Heat Exchanger

The utilization heat exchanger 310 causes heat exchange between a refrigerant and indoor air. Examples of the utilization heat exchanger 310 include a fin-and-tube heat exchanger constituted by a plurality of heat transfer tubes and a fin. The utilization unit 300A includes an indoor fan (not depicted) configured to suck indoor air into the utilization unit 300A, supply the utilization heat exchanger 310 with the indoor air, and supply air after heat exchange in the utilization heat exchanger 310 into the room. The indoor fan is driven by an indoor fan motor (not depicted).

(2-2-2) Temperature Sensor

The utilization unit 300A includes the plurality of temperature sensors configured to measure temperature of a refrigerant. The temperature sensors configured to measure temperature of a refrigerant include the liquid-side temperature sensor T5*a* configured to measure temperature of the refrigerant on the liquid side (at an outlet of the utilization heat exchanger 310 functioning as a radiator for a refrigerant) of the utilization heat exchanger 310. The liquid-side temperature sensor T5*a* exemplifies a temperature measurement unit. The temperature sensors configured to measure temperature of a refrigerant also include the gas-side temperature sensor T6*a* configured to measure temperature of the refrigerant on a gas side (at an inlet of the utilization heat exchanger 310 functioning as a radiator for a refrigerant) of the utilization heat exchanger 310.

The utilization unit 300A includes the space temperature sensor Tb exemplifying a space temperature measurement unit and configured to measure temperature in a room as a temperature adjustment target space (air conditioning target space) of the utilization unit 300A.

(2-2-3) Utilization Unit Controller

The utilization unit controller 390 in the utilization unit 300A includes a microcomputer and a memory provided for control of the utilization unit 300A. The utilization unit controller 390 in the utilization unit 300A is electrically connected to various sensors including the temperature sensors T5*a*, T6*a*, and Tb (FIG. 2 does not depict connection between the utilization unit controller 390 and the sensors). The utilization unit controller 390 in the utilization unit 300A is also electrically connected to the heat source unit controller 190 in the heat source unit 100A and the connection unit controller 290 in the connection unit 200A, for transmission and reception of control signals to and from the heat source unit controller 190 and the connection unit controller 290. The heat source unit controllers 190, the connection unit controllers 290, and the utilization unit controllers 390 operate in cooperation as the control unit 400 configured to control the air conditioner 10. Control of the air conditioner 10 by the control unit 400 will be described later.

(2-3) Connection Unit

The connection unit 200A will be described with reference to FIG. 2. The connection unit 200B is configured similarly to the connection unit 200A, and thus will not be described herein to avoid repeated description.

The connection unit 200A and the utilization unit 300A are installed together. The connection unit 200A may be installed in a ceiling cavity of the room and adjacent to the utilization unit 300A.

The connection unit 200A is connected to the heat source units 100 (100A and 100B) via the refrigerant connection pipes 32, 34, and 36. The connection unit 200A is also connected to the utilization unit 300A via the connecting pipes 42 and 44. The connection unit 200A constitutes part of the refrigerant circuit 50. The connection unit 200A is disposed between the heat source unit 100 and the utilization unit 300A, and switches a flow of a refrigerant flowing into the heat source unit 100 and the utilization unit 300A.

The connection unit 200A includes a connection refrigerant circuit 50*c* constituting part of the refrigerant circuit 50. The connection refrigerant circuit 50*c* mainly includes a liquid refrigerant pipe 250 and a gas refrigerant pipe 260. The connection unit 200A further includes the connection unit controller 290.

(2-3-1) Connection Refrigerant Circuit (2-3-1-1) Liquid Refrigerant Pipe

The liquid refrigerant pipe 250 includes a main liquid refrigerant pipe 252 and a branching liquid refrigerant pipe 254.

The main liquid refrigerant pipe 252 connects the liquid-refrigerant connection pipe 32 and the liquid connecting pipe 42. The branching liquid refrigerant pipe 254 connects the main liquid refrigerant pipe 252 and a low-pressure gas refrigerant pipe 264 of the gas refrigerant pipe 260 to be described later. The branching liquid refrigerant pipe 254 is provided with a branching pipe control valve 220. The branching pipe control valve 220 is exemplarily configured as an electric expansion valve having a controllable opening degree. The main liquid refrigerant pipe 252 is provided with a subcooling heat exchanger 210 disposed at a position shifted from a branching point of the branching liquid refrigerant pipe 254 toward the liquid connecting pipe 42. If the branching pipe control valve 220 is opened when the refrigerant flows from the liquid side to the gas side in the utilization heat exchanger 310 of the utilization unit 300A, the subcooling heat exchanger 210 causes heat exchange between the refrigerant flowing through the main liquid refrigerant pipe 252 and the refrigerant flowing through the branching liquid refrigerant pipe 254 from the main liquid refrigerant pipe 252 to the low-pressure gas refrigerant pipe 264 to cool the refrigerant flowing through the main liquid refrigerant pipe 252. The subcooling heat exchanger 210 is exemplarily configured as a double pipe heat exchanger.

(2-3-1-2) Gas Refrigerant Pipe

The gas refrigerant pipe 260 includes a high and low-pressure gas refrigerant pipe 262, the low-pressure gas refrigerant pipe 264, and a joined gas refrigerant pipe 266. The high and low-pressure gas refrigerant pipe 262 has a first end connected to the high and low-pressure gas-refrigerant connection pipe 34 and a second end connected to the joined gas refrigerant pipe 266. The low-pressure gas refrigerant pipe 264 has a first end connected to the low-pressure gas-refrigerant connection pipe 36 and a second end connected to the joined gas refrigerant pipe 266. The joined gas refrigerant pipe 266 has a first end connected to the high and low-pressure gas refrigerant pipe 262 and the low-pressure gas refrigerant pipe 264, and a second end connected to the gas connecting pipe 44. The high and low-pressure gas refrigerant pipe 262 is provided with a high and low-pressure valve 230. The low-pressure gas refrigerant pipe 264 is provided with a low pressure valve 240. Each of the high and low-pressure valve 230 and the low pressure valve 240 may be configured as a motor valve.

(2-3-2) Connection Unit Controller

The connection unit controller 290 includes a microcomputer and a memory provided for control of the connection unit 200A. The connection unit controller 290 is electrically connected to the heat source unit controller 190 in the heat source unit 100A and the utilization unit controller 390 in the utilization unit 300A, for transmission and reception of control signals to and from the heat source unit controller 190 and the utilization unit controller 390. The heat source unit controllers 190, the connection unit controllers 290, and the utilization unit controllers 390 operate in cooperation as the control unit 400 configured to control the air conditioner 10. Control of the air conditioner 10 by the control unit 400 will be described later.

(2-3-3) Refrigerant Flow Rate Switching by Connection Unit

When the utilization unit 300A executes cooling operation, the connection unit 200A brings the low pressure valve 240 into an opened state, and sends the refrigerant flowing from the liquid-refrigerant connection pipe 32 into the main liquid refrigerant pipe 252 to the utilization heat exchanger 310 via the liquid connecting pipe 42 and the utilization flow-rate control valve 320 of the utilization refrigerant circuit 50*b* in the utilization unit 300A. The connection unit 200A sends, to the low-pressure gas-refrigerant connection pipe 36 via the joined gas refrigerant pipe 266 and the low-pressure gas refrigerant pipe 264, the refrigerant evaporated through heat exchange with indoor air in the utilization heat exchanger 310 of the utilization unit 300A and flowed into the gas connecting pipe 44.

When the utilization unit 300A executes heating operation, the connection unit 200A brings the low pressure valve 240 into a closed state and brings the high and low-pressure valve 230 into the opened state, and sends the refrigerant flowing through the high and low-pressure gas-refrigerant connection pipe 34 into the high and low-pressure gas refrigerant pipe 262, to the utilization heat exchanger 310 in the utilization refrigerant circuit 50*b* of the utilization unit 300A via the joined gas refrigerant pipe 266 and gas connecting pipe 44. The connection unit 200A sends, to the liquid-refrigerant connection pipe 32 via the main liquid refrigerant pipe 252, the refrigerant which radiated heat through heat exchange with indoor air in the utilization heat exchanger 310 and flowed into the liquid connecting pipe 42 via the utilization flow-rate control valve 320.

(2-4) Control Unit

The control unit 400 is a functional unit configured to control the air conditioner 10. To function as the control unit 400, the heat source unit controllers 190 in the heat source units 100, the connection unit controllers 290 in the connection units 200, and the utilization unit controllers 390 in the utilization units 300 operate in cooperation. The present embodiment is not limited to this configuration, but the control unit 400 may alternatively be configured as a control device independent from the heat source units 100, the connection units 200, and the utilization units 300.

The control unit 400 includes a microcomputer and causes the microcomputer to execute a program stored in a storage unit 410 included in the control unit 400, to control operation of the air conditioner 10. Herein, the memories of the heat source unit controllers 190, the connection unit controllers 290, and the utilization unit controllers 390 are collectively called the storage unit 410 of the control unit 400, whereas the microcomputers of the heat source unit controllers 190, the connection unit controllers 290, and the utilization unit controllers 390 are collectively called the microcomputer of the control unit 400.

The control unit 400 controls operation of various constituent equipment of the heat source units 100, the connection units 200, and the utilization units 300 in accordance with measurement values of various sensors included in the air conditioner 10 as well as a command or setting inputted by a user to an operation unit (not depicted; e.g. a remote controller) to achieve an appropriate operation condition. The control unit 400 has operation control target equipment including the compressor 110, the heat source-side flow-rate control valve 150, the first flow path switching mechanism 132, the second flow path switching mechanism 134, the gas vent pipe flow-rate control valve 182, the first suction return valve 162, the second suction return valve 172, the bypass valve 128, and the fan 166 in each of the heat source units 100. The operation control target equipment of the control unit 400 further include the utilization flow-rate control valve 320 and the indoor fan in each of the utilization units 300. The operation control target equipment of the control unit 400 also include the branching pipe control valve 220, the high and low-pressure valve 230, and the low pressure valve 240 in each of the connection units 200.

Brief description will be made later to control of various constituent equipment in the air conditioner 10 by the control unit 400 during cooling operation of the air conditioner 10 (when the utilization units 300A and 300B both execute cooling operation), during heating operation (when the utilization units 300A and 300B both execute heating operation), and during simultaneous cooling and heating operation (when the utilization unit 300A executes cooling operation and the utilization unit 300B executes heating operation).

Further described below are control to cool the interior of the casing 106 (operation to cool the interior of the casing) and control to reduce the occurrence of dew condensation and freezing at the utilization unit 300 by the control unit 400.

Figure 5:
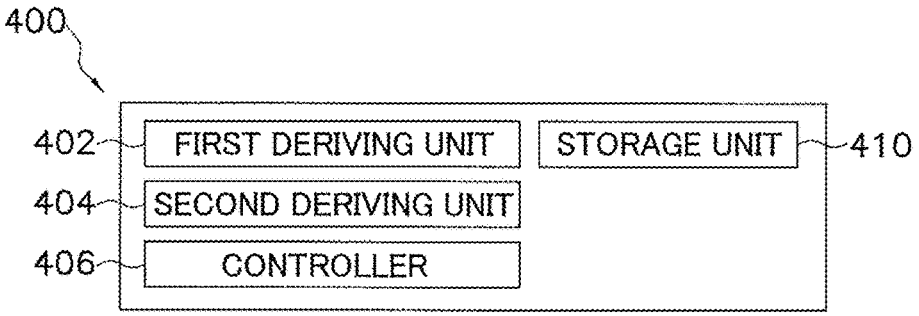
FIG. 5 is a block diagram of functional units in a control unit included in the air conditioner depicted in FIG. 1, that particularly shows the functional units relevant to control of capacity of a compressor in the heat source unit, open and close of a first suction return valve, and open and close of a bypass valve.

The microcomputer in the control unit 400 has a first deriving unit 402, a second deriving unit 404, and a controller 406 as depicted in FIG. 5, as functional units relevant to control to cool the interior of the casing 106 and control to reduce the occurrence of dew condensation and freezing at the utilization unit 300.

(2-4-1) First Deriving Unit

The first deriving unit 402 derives first pressure Pr1 upstream of the first suction return valve 162 in the refrigerant flow direction F (see FIG. 2) of the refrigerant flowing to the cooling heat exchanger 160 when the first suction return valve 162 is opened. The refrigerant flow direction F is a direction along the first suction return pipe 160*a* from the branching point B1 on the pipe connecting the receiver 180 and the liquid-side shutoff valve 22 toward the suction side (the suction pipe 110*a*) of the compressor 110. The first deriving unit 402 derives pressure of the refrigerant around the branching point B1 on the pipe connecting the receiver 180 and the liquid-side shutoff valve 22.

Specifically, the first deriving unit 402 calculates the first pressure Pr1 in accordance with information on a relation between temperature and pressure of a refrigerant (e.g. a correspondence table on saturation temperature and pressure of a refrigerant) stored in the storage unit 410 of the control unit 400 and temperature measured by the liquid-refrigerant temperature sensor T1 disposed adjacent to the branching point B1 on the refrigerant pipe.

In this embodiment, the first deriving unit 402 calculates the first pressure Pr1 in accordance with the temperature measured by the liquid-refrigerant temperature sensor T1. However, a method of deriving the first pressure Pr1 is not limited thereto. In a case where the first flow path switching mechanism 132 connects the discharge pipe 110*b* and the gas side of the heat source-side heat exchanger 140 to cause the heat source-side heat exchanger 140 to function as a radiator, the first deriving unit 402 may calculate the first pressure Pr1 by subtracting, from pressure measured by the pressure sensor P1, a pressure loss between the pressure sensor P1 and the branching point B1 obtained from a current opening degree of the heat source-side flow-rate control valve 150 or the like. There may be provided a pressure sensor adjacent to the branching point B1 on the refrigerant pipe and the first deriving unit 402 may calculate the first pressure Pr1 directly from a measurement value of the pressure sensor.

(2-4-2) Second Deriving Unit

The second deriving unit 404 derives second pressure Pr2 downstream of the cooling heat exchanger 160 in the refrigerant flow direction F (see FIG. 2) of the refrigerant flowing to the cooling heat exchanger 160 when the first suction return valve 162 is opened. In other words, the second deriving unit 404 derives pressure of the refrigerant in the suction pipe 110*a*.

Specifically, the second deriving unit 404 derives, as the second pressure Pr2, suction pressure of the compressor 110 measured by the pressure sensor P2. This is an exemplary method of deriving the second pressure Pr2 by the second deriving unit 404, and the second pressure Pr2 may alternatively be derived in accordance with temperature of the refrigerant or the like.

(2-4-3) Controller

The controller 406 controls operation of the compressor 110, operation (to open and close) of the first suction return valve 162, and operation (to open and close) of the bypass valve 128.

When the controller 406 controls to inhibit dew condensation and freezing at the utilization unit 300, air in the casing 106 is cooled accordingly. Control to cool the interior of the casing 106 and control to inhibit dew condensation and freezing at the utilization unit 300 are originally independent from each other, and are thus described separately below.

(2-4-3-1) Control to Cool Interior of Casing

The controller 406 has a casing interior cooling mode as an operating mode. The casing interior cooling mode is an operating mode with a main purpose of cooling the interior of the casing 106. The controller 406 controls to cool the interior of the casing 106 while the casing interior cooling mode is adopted. Generally, the controller 406 opens the first suction return valve 162 to supply the cooling heat exchanger 160 with the refrigerant to cause the cooling heat exchanger 160 to function as a heat absorber when temperature in the casing 106 measured by the casing internal temperature sensor Ta is higher than set temperature C2 exemplifying second predetermined temperature while the casing interior cooling mode is adopted.

The casing interior cooling mode is preferred to be a selectively adoptable operating mode (selectably adopted or unadopted). For example, when the temperature in the casing 106 is typically unexpected to increase excessively due to an installation condition of the casing 106 or the like, the controller 406 is preferably configured to select no adoption of the casing interior cooling mode in accordance with a selection by the user or the like.

The controller 406 controls to cool the interior of the casing 106 as follows while the casing interior cooling mode is adopted.

The controller 406 basically controls to open or close the first suction return valve 162 in accordance with the temperature measured by the casing internal temperature sensor Ta. Specifically, the controller 406 opens the first suction return valve 162 to cool the interior of the casing 106 when the temperature measured by the casing internal temperature sensor Ta exceeds the predetermined set temperature C2. When the first suction return valve 162 is opened, the liquid refrigerant flows from the pipe connecting the receiver 180 and the liquid-side shutoff valve 22 into the cooling heat exchanger 160. The liquid refrigerant flowed into the cooling heat exchanger 160 exchanges heat with air in the casing 106 to cool the air and evaporate.

The controller 406 assesses, before the first suction return valve 162 is actually opened to supply the cooling heat exchanger 160 with the refrigerant, whether or not the refrigerant flowing from the cooling heat exchanger 160 toward the compressor 110 comes into a wet state when the refrigerant is supplied to the cooling heat exchanger 160, and determines whether or not to open the first suction return valve 162 in accordance with an assessment result. Specifically, the controller 406 assesses whether or not the liquid refrigerant supplied to the cooling heat exchanger 160 entirely evaporates when the refrigerant is supplied to the cooling heat exchanger 160, and determines whether or not to open the first suction return valve 162 in accordance with an assessment result. In other words, the controller 406 assesses whether or not the refrigerant immediately after flowing out of the cooling heat exchanger 160 entirely comes into the gaseous state when the refrigerant is supplied to the cooling heat exchanger 160, and determines whether or not to open the first suction return valve 162 in accordance with an assessment result.

The controller 406 assesses whether or not the refrigerant flowing from the cooling heat exchanger 160 toward the compressor 110 comes into the wet state when the refrigerant is supplied to the cooling heat exchanger 160, in accordance with pressure difference ΔP between the first pressure Pr1 derived by the first deriving unit 402 and the second pressure Pr2 derived by the second deriving unit 404. Furthermore, the controller 406 assesses whether or not the refrigerant flowing from the cooling heat exchanger 160 toward the compressor 110 comes into the wet state when the refrigerant is supplied to the cooling heat exchanger 160, in accordance with the temperature measured by the casing internal temperature sensor Ta. Specifically, the controller 406 assesses whether or not the refrigerant immediately after flowing out of the cooling heat exchanger 160 entirely comes into the gaseous state in the following manner when the refrigerant is supplied to the cooling heat exchanger 160.

The controller 406 calculates the pressure difference ΔP (=Pr1−Pr2) between the current first pressure Pr1 derived by the first deriving unit 402 and the current second pressure Pr2 derived by the second deriving unit 404 before the first suction return valve 162 is opened to supply the cooling heat exchanger 160 with the refrigerant. The controller 406 then calculates a flow rate of the refrigerant expected to be supplied to the cooling heat exchanger 160 when the first suction return valve 162 opens, in accordance with the pressure difference ΔP and information on a relation between pressure difference and a flow rate of a liquid refrigerant stored in the storage unit 410 of the control unit 400. Examples of the information on the relation between pressure difference and a flow rate of a liquid refrigerant stored in the storage unit 410 of the control unit 400 include a preliminarily derived table indicating a relation between pressure difference and a flow rate, and a relational expression between the pressure difference and the flow rate.

Figure 6:
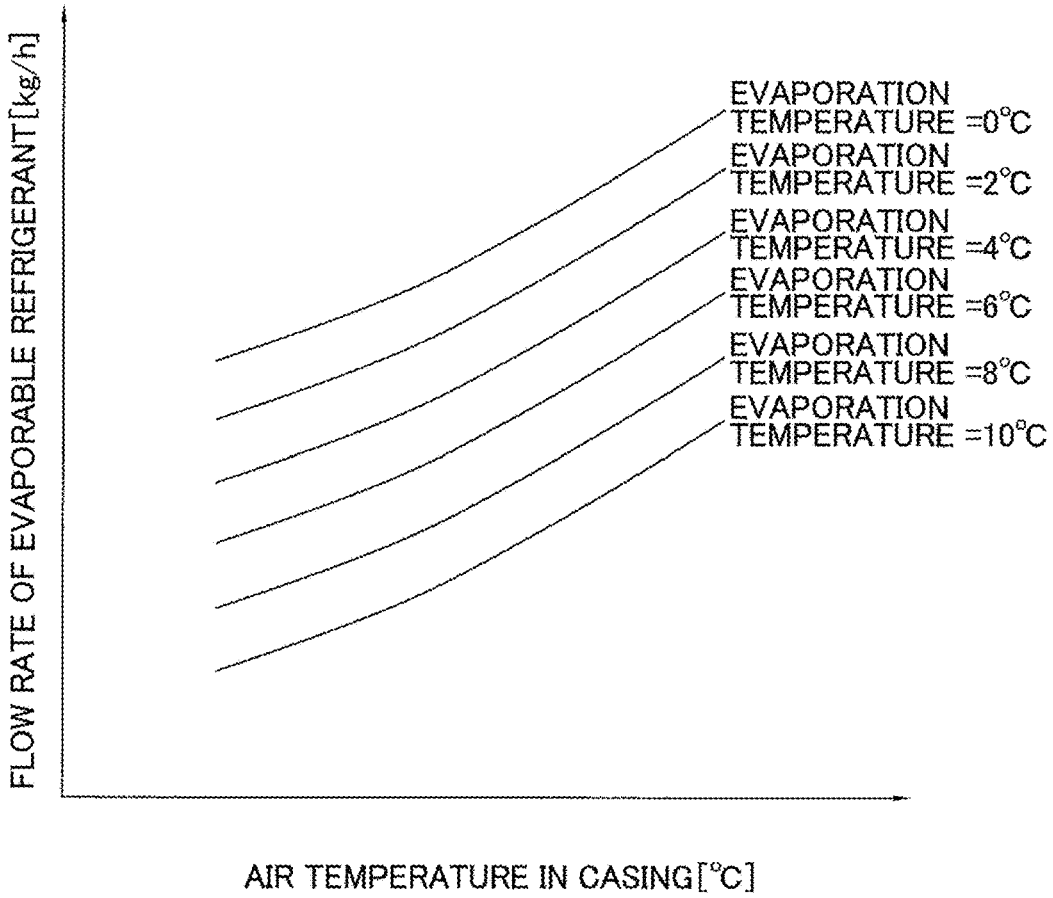
FIG. 6 is a conceptual graph indicating relations, at different evaporation temperature levels in a refrigeration cycle, between a flow rate of a refrigerant evaporable in a cooling heat exchanger of the heat source unit in the air conditioner depicted in FIG. 1 and air temperature in a casing of the heat source unit.

Further, the controller 406 calculates, before the first suction return valve 162 is opened to supply the cooling heat exchanger 160 with the refrigerant, quantity of the liquid refrigerant evaporable in the cooling heat exchanger 160 when the refrigerant is supplied to the cooling heat exchanger 160 in accordance with the temperature in the casing 106 measured by the casing internal temperature sensor Ta. More specifically, the controller 406 calculates a flow rate of the liquid refrigerant evaporable in the cooling heat exchanger 160 when the refrigerant is supplied to the cooling heat exchanger 160, in accordance with the temperature in the casing 106 measured by the casing internal temperature sensor Ta and the evaporation temperature in the refrigeration cycle. For example, the controller 406 calculates quantity of the liquid refrigerant evaporable in the cooling heat exchanger 160 when the refrigerant is supplied to the cooling heat exchanger 160, from the evaporation temperature in the refrigeration cycle and the temperature in the casing 106 measured by the casing internal temperature sensor Ta, in accordance with a relation between quantity of a liquid refrigerant evaporable in the cooling heat exchanger 160 and air temperature in the casing 106 at different evaporation temperature levels in the refrigeration cycle as indicated in FIG. 6 and stored in the storage unit 410 of the control unit 400. The controller 406 calculates the evaporation temperature in the refrigeration cycle in accordance with the second pressure Pr2 measured by the pressure sensor P2 and the information on the relation between temperature and pressure of a refrigerant (e.g. the correspondence table on saturation temperature and pressure of the refrigerant) stored in the storage unit 410 of the control unit 400. FIG. 6 conceptually indicates the relation between quantity of the refrigerant evaporable in the cooling heat exchanger 160 and air temperature in the casing 106 at different evaporation temperature levels in the refrigeration cycle, and the storage unit 410 of the control unit 400 may actually store information in the form of a table or a mathematical expression.

The controller 406 compares quantity (hereinafter called quantity A1) of the liquid refrigerant evaporable in the cooling heat exchanger 160 when the first suction return valve 162 is opened and quantity (hereinafter called quantity A2) of the liquid refrigerant expected to be supplied to the cooling heat exchanger 160 when the first suction return valve 162 is opened. In a case where the quantity A2≤the quantity A1 is established, the controller 406 assesses that the refrigerant immediately after flowing out of the cooling heat exchanger 160 entirely comes into the gaseous state when the refrigerant is supplied to the cooling heat exchanger 160. The controller 406 then determines to open the first suction return valve 162. In another case where the quantity A2>the quantity A1 is established, the controller 406 assesses that the refrigerant immediately after flowing out of the cooling heat exchanger 160 is partially in the liquid state when the refrigerant is supplied to the cooling heat exchanger 160. The controller 406 then determines not to open the first suction return valve 162 (to keep the first suction return valve 162 closed).

(2-4-3-2) Control for Inhibiting Dew Condensation and Freezing at Utilization Unit The controller 406 performs control for inhibiting dew condensation and freezing at the utilization unit, in order to inhibit dew condensation at the utilization unit 300 and freezing of dew condensation water on a surface of the utilization heat exchanger 310 in the utilization unit 300 due to decrease in temperature of the refrigerant flowing to the utilization unit 300 during cooling operation in which the heat source-side heat exchanger 140 functioning as a radiator (condenser).

During cooling operation, the cooling load of the utilization units 300 decreases when part (in particular, most) of the plurality of utilization units 300 stop cooling operation or when part (in particular, most) of the utilization units 300 make temperatures of their air conditioning target spaces approach target temperatures. When the cooling capacity of the utilization units 300 decreases, the utilization units 300 do not require much refrigerant. If the refrigerant having excessive quantity is sent to the utilization unit 300, the refrigerant flowing into the utilization unit 300 has temperature decrease to possibly cause dew condensation at a pipe, the utilization heat exchanger 310, and the like in the utilization unit 300 and freezing of dew condensation water on a surface of the utilization heat exchanger 310.

The controller 406 thus decreases the capacity (the number of rotations) of the compressor 110 in accordance with the cooling load of the utilization unit 300 during cooling operation in which the heat source-side heat exchanger 140 functions as a radiator (condenser). The controller 406 decreases the capacity of the compressor 110 to the predetermined capacity in accordance with the cooling load of the utilization unit 300. The predetermined capacity is equal to the minimum capacity (the minimum capacity allowing the compressor 110 to operate) in this case. The present invention should not be limited to this case, but the predetermined capacity may alternatively be the minimum capacity of an operation range in which the compressor 110 can operate with relatively high efficiency. The predetermined capacity may still alternatively indicate capacity less than a predetermined threshold. The controller 406 may control the opening degrees of the flow-rate control valves 150 and 320 as well as the capacity of the compressor 110.

The controller 406 further opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity. In particular, the controller 406 according to the present embodiment opens the first suction return valve 162 to supply the cooling heat exchanger 160 with the refrigerant to cause the cooling heat exchanger 160 to function as a heat absorber when assessing that the refrigerant sent to the utilization unit 300 needs to be further decreased in quantity after the capacity of the compressor 110 is decreased to the predetermined capacity. Further, the controller 406 controls to open the bypass valve 128 when assessing that the refrigerant sent to the utilization unit 300 needs to be decreased in quantity. In particular, the controller 406 according to the present embodiment controls to open the bypass valve 128 when assessing that the refrigerant sent to the utilization unit 300 needs to be further decreased in quantity after the capacity of the compressor 110 is decreased to the predetermined capacity.

A flow of control for inhibiting dew condensation and freezing at the utilization unit 300 will be described later in detail with reference to a flowchart.

The controller 406 assesses whether or not the refrigerant sent to the utilization unit 300 needs to be decreased in quantity in accordance with whether or not the low pressure (pressure measured by the low pressure sensor P2) in the refrigeration cycle is decreased to be equal to or less than a predetermined threshold. The controller 406 may alternatively assess whether or not the refrigerant sent to the utilization unit 300 needs to be decreased in quantity in accordance with whether or not the low pressure in the refrigeration cycle is assessed as being decreased to be equal to or less than the predetermined threshold (whether or not the pressure measured by the low pressure sensor P2 tends to decrease).

The controller 406 may still alternatively assess whether or not the refrigerant sent to the utilization unit 300 needs to be decreased in quantity in accordance with a state of the utilization unit 300 in cooling operation, in place of or in addition to the value of the low pressure in the refrigeration cycle.

For example, the controller 406 may assess whether or not the refrigerant sent to the utilization unit 300 needs to be decreased in quantity in accordance with temperature measured by the liquid-side temperature sensor T5*a* or T5*b* configured to measure temperature of the refrigerant flowing in the utilization heat exchanger 310. Specifically, the controller 406 may assess that the refrigerant sent to the utilization unit 300 needs to be decreased in quantity when the temperature measured by the liquid-side temperature sensor T5*a* or T5*b* in the utilization unit 300 in cooling operation is lower than a predetermined temperature causing dew condensation at the utilization unit 300.

For example, the controller 406 may alternatively assess whether or not the refrigerant sent to the utilization unit 300 needs to be decreased in quantity in accordance with temperature measured by the space temperature sensor Tb in the utilization unit 300 in cooling operation. Specifically, the controller 406 may assess whether or not the refrigerant sent to the utilization unit 300 needs to be decreased in quantity in accordance with the temperature measured by the space temperature sensor Tb in the utilization unit 300 in cooling operation and the target temperature (set temperature by the user) in the temperature adjustment target space of the utilization unit 300 as stored in the storage unit 410. For example, the controller 406 may assess that the refrigerant sent to the utilization unit 300 needs to be decreased in quantity when the temperature measured by the space temperature sensor Tb approaches the target temperature (e.g. when a difference between the temperature measured by the space temperature sensor Tb and the target temperature becomes less than a predetermined value).

(3) OPERATION OF AIR CONDITIONER

Described below is ordinary operation of the air conditioner 10 when the utilization units 300A and 300B both execute cooling operation, when the utilization units 300A and 300B both execute heating operation, and when the utilization unit 300A executes cooling operation and the utilization unit 300B executes heating operation. The following description relates to an exemplary case where only the heat source unit 100A in the heat source units 100 operates.

Operation of the air conditioner 10 will be exemplified herein, and may be appropriately modified within a range in which the utilization units 300A and 300B can exhibit desired cooling and heating functions.

(3-1) When all Operated Utilization Units Execute Cooling Operation

The following description relates to the case where the utilization units 300A and 300B both execute cooling operation, in other words, where the utilization heat exchangers 310 in the utilization units 300A and 300B each function as a heat absorber (evaporator) for a refrigerant and the heat source-side heat exchanger 140 functions as a radiator (condenser) for a refrigerant.

The control unit 400 switches the first flow path switching mechanism 132 into the radiating operation state (the state indicated by the solid line of the first flow path switching mechanism 132 in FIG. 2) to cause the heat source-side heat exchanger 140 to function as a radiator for a refrigerant. The control unit 400 switches the second flow path switching mechanism 134 into the evaporation load operation state (the state indicated by the solid line of the second flow path switching mechanism 134 in FIG. 2). The control unit 400 appropriately controls the opening degrees of the heat source-side flow-rate control valve 150 and the second suction return valve 172. The control unit 400 further controls to bring the gas vent pipe flow-rate control valve 182 into a fully closed state. The control unit 400 brings the branching pipe control valves 220 into the closed state and brings the high and low-pressure valves 230 and the low pressure valves 240 into the opened state in the connection units 200A and 200B, to cause the utilization heat exchangers 310 in the utilization units 300A and 300B to each function as an evaporator for a refrigerant. When the control unit 400 brings the high and low-pressure valves 230 and the low pressure valves 240 into the opened state, the utilization heat exchangers 310 in the utilization units 300A and 300B and the suction side of the compressor 110 in the heat source unit 100A are connected via the high and low-pressure gas-refrigerant connection pipe 34 and the low-pressure gas-refrigerant connection pipe 36. The control unit 400 appropriately controls the opening degrees of the utilization flow-rate control valves 320 in the utilization units 300A and 300B.

Figure 7A:
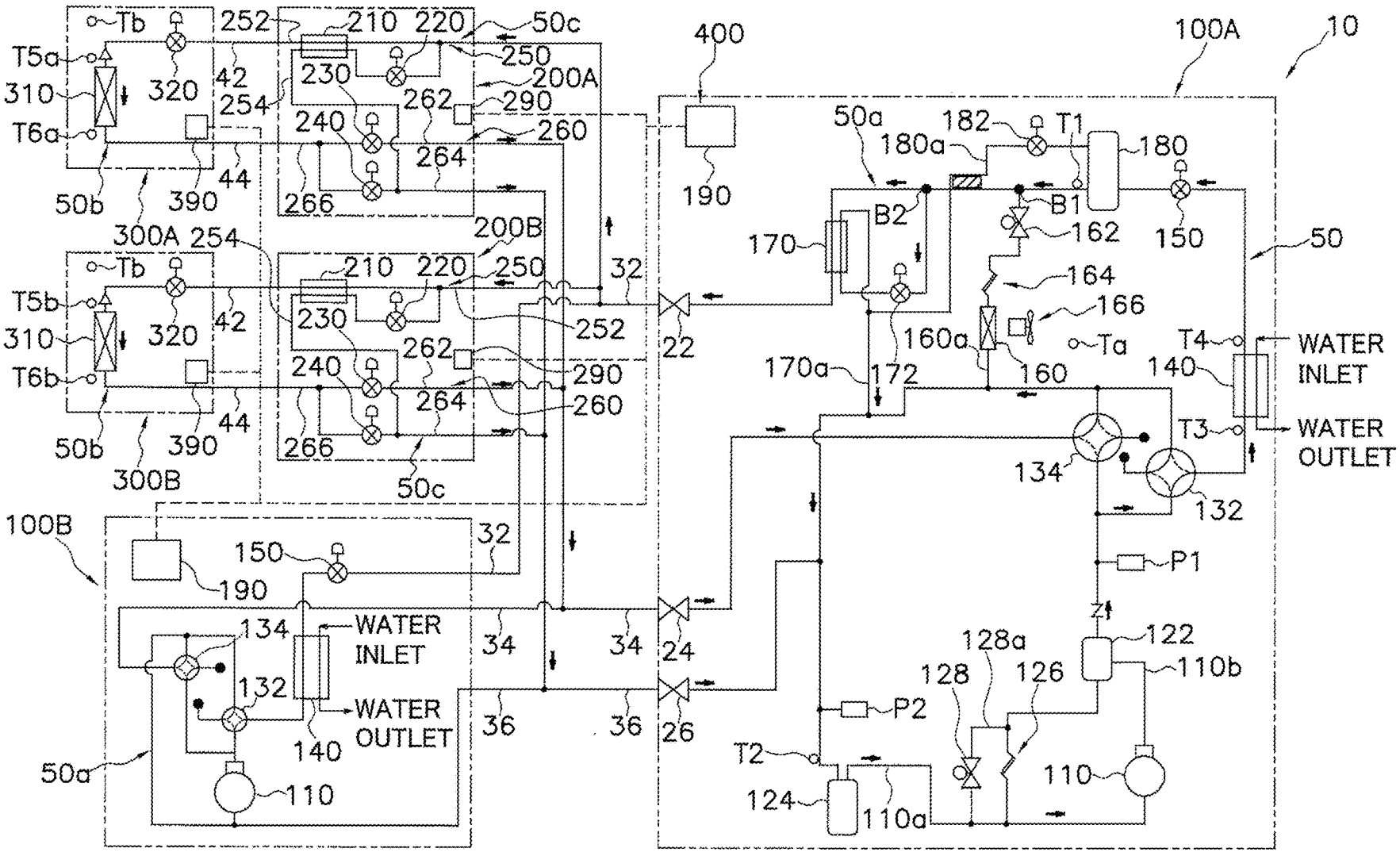
FIG. 7A is an explanatory diagram on a flow of the refrigerant in the refrigerant circuit in a case where two utilization units each execute cooling operation in the air conditioner depicted in FIG. 1.

The control unit 400 operates the respective units in the air conditioner 10 as described above to allow the refrigerant to circulate in the refrigerant circuit 50 as indicated by arrows in FIG. 7A.

The high-pressure gas refrigerant compressed by and discharged from the compressor 110 is sent to the heat source-side heat exchanger 140 via the first flow path switching mechanism 132. The high-pressure gas refrigerant sent to the heat source-side heat exchanger 140 radiates heat to be condensed through heat exchange with water as the heat source in the heat source-side heat exchanger 140. The refrigerant which radiated heat in the heat source-side heat exchanger 140 is flow-rate controlled by the heat source-side flow-rate control valve 150 and is then sent to the receiver 180. The refrigerant sent to the receiver 180 is temporarily stored in the receiver 180 and then flows out, and the refrigerant partially flows to the second suction return pipe 170*a* via the branching point B2 whereas the remaining thereof flows toward the liquid-refrigerant connection pipe 32. The refrigerant flowing from the receiver 180 to the liquid-refrigerant connection pipe 32 is cooled through heat exchange in the subcooling heat exchanger 170 with the refrigerant flowing through the second suction return pipe 170*a* toward the suction pipe 110*a* of the compressor 110, and then flows through the liquid-side shutoff valve 22 into the liquid-refrigerant connection pipe 32. The refrigerant sent to the liquid-refrigerant connection pipe 32 is branched into two ways to be sent to the main liquid refrigerant pipes 252 in the connection units 200A and 200B. The refrigerant sent to the main liquid refrigerant pipes 252 in the connection units 200A and 200B flows through the liquid connecting pipes 42 to be sent to the utilization flow-rate control valves 320 in the utilization units 300A and 300B. The refrigerant sent to each of the utilization flow-rate control valves 320 is flow-rate controlled by the utilization flow-rate control valve 320 and is then evaporated to become a low-pressure gas refrigerant through heat exchange in the utilization heat exchanger 310 with indoor air supplied from the indoor fan (not depicted). Meanwhile, the indoor air is cooled and is supplied into the room. The low-pressure gas refrigerant flowing out of the utilization heat exchangers 310 in the utilization units 300A and 300B is sent to the joined gas refrigerant pipes 266 in the connection units 200A and 200B. The low-pressure gas refrigerant sent to each of the joined gas refrigerant pipes 266 is sent to the high and low-pressure gas-refrigerant connection pipe 34 via the high and low-pressure gas refrigerant pipe 262 as well as to the low-pressure gas-refrigerant connection pipe 36 via the low-pressure gas refrigerant pipe 264. The low-pressure gas refrigerant sent to the high and low-pressure gas-refrigerant connection pipe 34 returns to the suction side (the suction pipe 110*a*) of the compressor 110 via the high and low-pressure gas-side shutoff valve 24 and the second flow path switching mechanism 134. The low-pressure gas refrigerant sent to the low-pressure gas-refrigerant connection pipe 36 returns to the suction side (the suction pipe 110*a*) of the compressor 110 via the low-pressure gas-side shutoff valve 26.

(3-2) When all Operated Utilization Units Execute Heating Operation

The following description relates to the case where the utilization units 300A and 300B both execute heating operation, in other words, where the utilization heat exchangers 310 in the utilization units 300A and 300B each function as a radiator (condenser) for a refrigerant and the heat source-side heat exchanger 140 functions as a heat absorber (evaporator) for a refrigerant.

The control unit 400 switches the first flow path switching mechanism 132 into an evaporating operation state (a state indicated by the broken line of the first flow path switching mechanism 132 in FIG. 2) to cause the heat source-side heat exchanger 140 to function as a heat absorber (evaporator) for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degree of the heat source-side flow-rate control valve 150. The control unit 400 brings the branching pipe control valves 220 and the low pressure valves 240 into the closed state and brings the high and low-pressure valves 230 into the opened state in the connection units 200A and 200B, to cause the utilization heat exchangers 310 in the utilization units 300A and 300B to each function as a radiator (condenser) for a refrigerant. When the control unit 400 brings the high and low-pressure valves 230 into the opened state, the discharge side of the compressor 110 and the utilization heat exchangers 310 in the utilization units 300A and 300B are connected via the high and low-pressure gas-refrigerant connection pipe 34. The control unit 400 appropriately controls the opening degrees of the utilization flow-rate control valves 320 in the utilization units 300A and 300B.

Figure 7B:
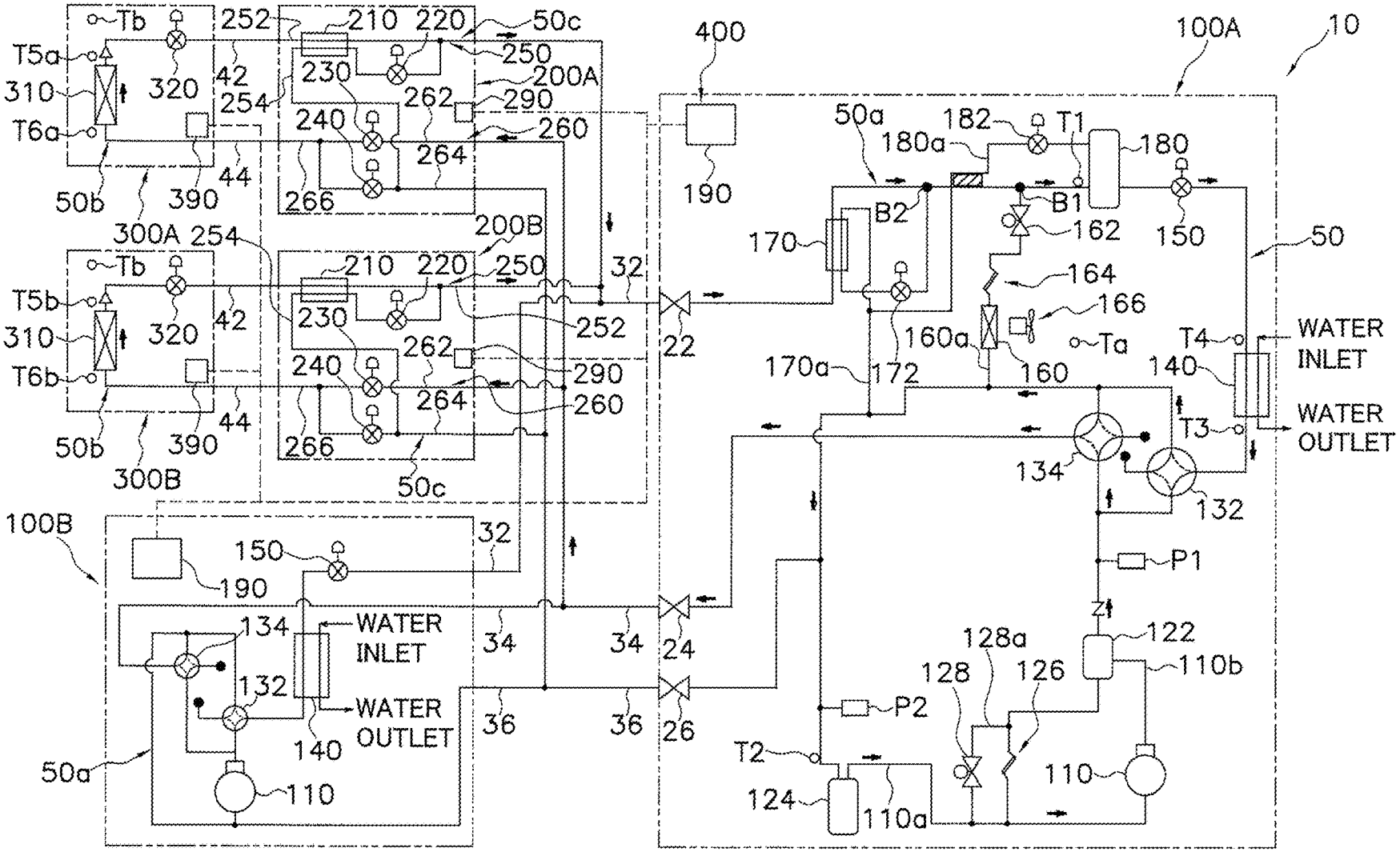
FIG. 7B is an explanatory diagram on a flow of the refrigerant in the refrigerant circuit in a case where the two utilization units each execute heating operation in the air conditioner depicted in FIG. 1.

The control unit 400 operates the respective units in the air conditioner 10 as described above to allow the refrigerant to circulate in the refrigerant circuit 50 as indicated by arrows in FIG. 7B.

The high-pressure gas refrigerant compressed by and discharged from the compressor 110 is sent to the high and low-pressure gas-refrigerant connection pipe 34 via the second flow path switching mechanism 134 and the high and low-pressure gas-side shutoff valve 24. The high-pressure gas refrigerant sent to the high and low-pressure gas-refrigerant connection pipe 34 branches to flow into the high and low-pressure gas refrigerant pipes 262 in the connection units 200A and 200B. The high-pressure gas refrigerant flowed into the high and low-pressure gas refrigerant pipes 262 is sent to the utilization heat exchanger 310 in each of the utilization units 300A and 300B via the high and low-pressure valve 230, the joined gas refrigerant pipe 266, and the gas connecting pipe 44. The high-pressure gas refrigerant sent to the utilization heat exchanger 310 radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchangers 310 in the utilization units 300A and 300B is flow-rate controlled by the utilization flow-rate control valves 320 in the utilization units 300A and 300B and is then sent to the main liquid refrigerant pipes 252 in the connection units 200A and 200B via the liquid connecting pipes 42. The refrigerant sent to the main liquid refrigerant pipes 252 is sent to the liquid-refrigerant connection pipe 32 and is then sent to the receiver 180 through the liquid-side shutoff valve 22. The refrigerant sent to the receiver 180 is temporarily stored in the receiver 180 and then flows out to be sent to the heat source-side flow-rate control valve 150. The refrigerant sent to the heat source-side flow-rate control valve 150 is evaporated to become a low-pressure gas refrigerant through heat exchange with water as the heat source in the heat source-side heat exchanger 140 and is sent to the first flow path switching mechanism 132. The low-pressure gas refrigerant sent to the first flow path switching mechanism 132 then returns to the suction side (the suction pipe 110*a*) of the compressor 110.

(3-3) When Simultaneous Cooling and Heating Operation is Executed (a) Mainly with Evaporation Load Described below is operation of the air conditioner 10 during simultaneous cooling and heating operation with a superior evaporation load of the utilization units 300. A superior evaporation load in the utilization units 300 is caused, for example, in a case where a large number of utilization units mostly execute cooling operation and the remaining small number of the utilization units execute heating operation. The following description relates to an exemplary case where there are provided only two utilization units 300 and the utilization unit 300A including the utilization heat exchanger 310 functioning as an evaporator for a refrigerant has a cooling load larger than a heating load of the utilization unit 300B including the utilization heat exchanger 310 functioning as a radiator for a refrigerant.

In this case, the control unit 400 switches the first flow path switching mechanism 132 into the radiating operation state (the state indicated by the solid line of the first flow path switching mechanism 132 in FIG. 2) to cause the heat source-side heat exchanger 140 to function as a radiator for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degrees of the heat source-side flow-rate control valve 150 and the second suction return valve 172. The control unit 400 further controls to bring the gas vent pipe flow-rate control valve 182 into a fully closed state. The control unit 400 brings the branching pipe control valve 220 and the high and low-pressure valve 230 into the closed state and brings the low pressure valve 240 into the opened state in the connection unit 200A, to cause the utilization heat exchanger 310 in the utilization unit 300A to function as an evaporator for a refrigerant. The control unit 400 brings the branching pipe control valve 220 and the low pressure valve 240 into the closed state and brings the high and low-pressure valve 230 into the opened state in the connection unit 200B, to cause the utilization heat exchanger 310 in the utilization unit 300B to function as a radiator for a refrigerant. When the valves are controlled as described above in the connection unit 200A, the utilization heat exchanger 310 in the utilization unit 300A and the suction side of the compressor 110 in the heat source unit 100A are connected via the low-pressure gas-refrigerant connection pipe 36. When the valves are controlled as described above in the connection unit 200B, the discharge side of the compressor 110 in the heat source unit 100A and the utilization heat exchanger 310 in the utilization unit 300B are connected via the high and low-pressure gas-refrigerant connection pipe 34. The control unit 400 appropriately controls the opening degrees of the utilization flow-rate control valves 320 in the utilization units 300A and 300B.

Figure 7C:
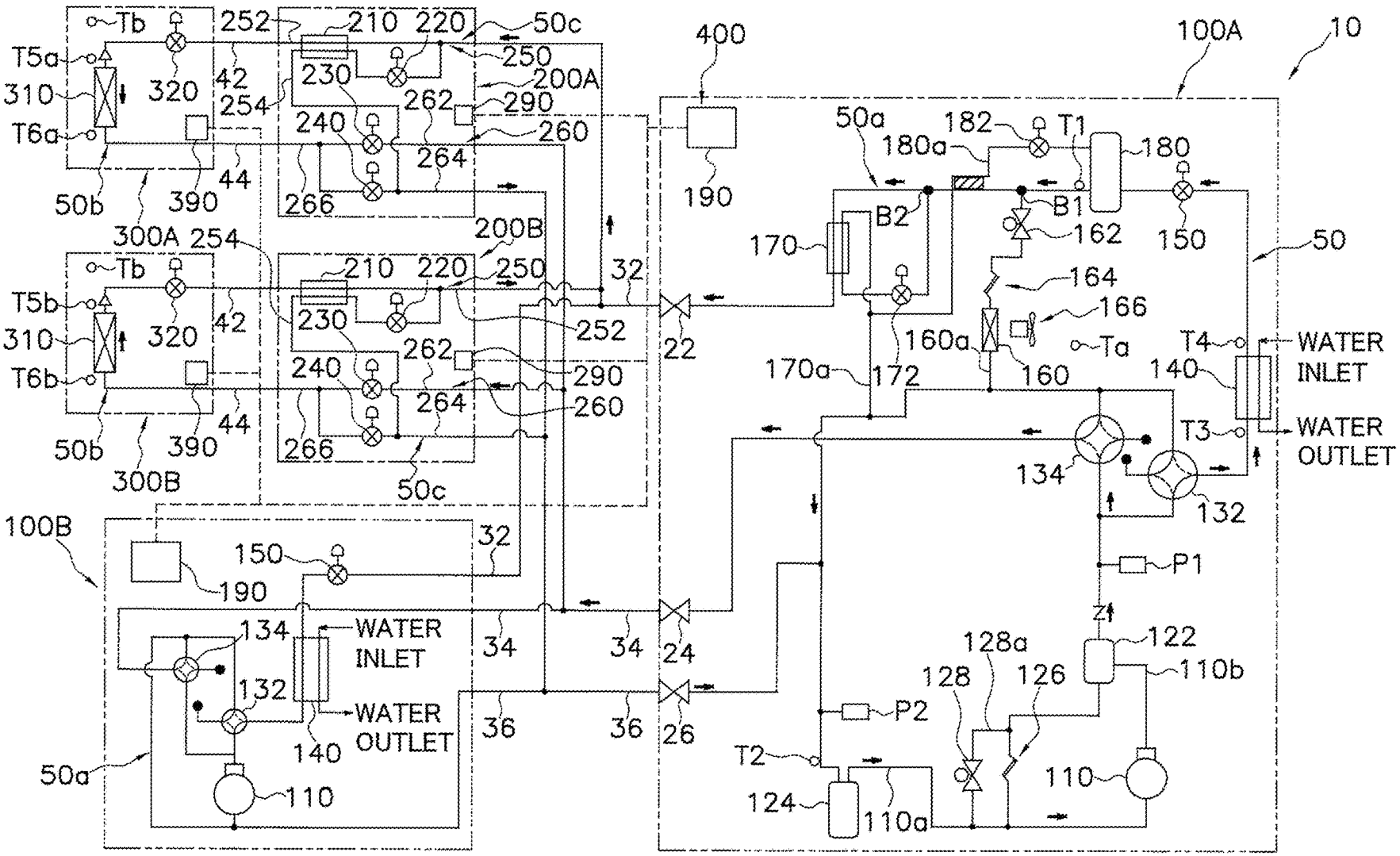
FIG. 7C is an explanatory diagram on a flow of the refrigerant in the refrigerant circuit in a case where one of the utilization units executes cooling operation and the other one of the utilization units executes heating operation in the air conditioner depicted in FIG. 1 mainly with an evaporation load.

The control unit 400 operates the respective units in the air conditioner 10 as described above to allow the refrigerant to circulate in the refrigerant circuit 50 as indicated by arrows in FIG. 7C.

The high-pressure gas refrigerant compressed by and discharged from the compressor 110 is partially sent to the high and low-pressure gas-refrigerant connection pipe 34 via the second flow path switching mechanism 134 and the high and low-pressure gas-side shutoff valve 24, and the remaining thereof is sent to the heat source-side heat exchanger 140 via the first flow path switching mechanism 132.

The high-pressure gas refrigerant sent to the high and low-pressure gas-refrigerant connection pipe 34 is sent to the high and low-pressure gas refrigerant pipe 262 in the connection unit 200B. The high-pressure gas refrigerant sent to the high and low-pressure gas refrigerant pipe 262 is sent to the utilization heat exchanger 310 in the utilization unit 300B via the high and low-pressure valve 230 and the joined gas refrigerant pipe 266. The high-pressure gas refrigerant sent to the utilization heat exchanger 310 in the utilization unit 300B radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchanger 310 in the utilization unit 300B is flow-rate controlled by the utilization flow-rate control valve 320 in the utilization unit 300B and is then sent to the main liquid refrigerant pipe 252 in the connection unit 200B. The refrigerant sent to the main liquid refrigerant pipe 252 in the connection unit 200B is sent to the liquid-refrigerant connection pipe 32.

The high-pressure gas refrigerant sent to the heat source-side heat exchanger 140 radiates heat to be condensed through heat exchange with water as the heat source in the heat source-side heat exchanger 140. The refrigerant which radiated heat in the heat source-side heat exchanger 140 is flow-rate controlled by the heat source-side flow-rate control valve 150 and is then sent to the receiver 180. The refrigerant sent to the receiver 180 is temporarily stored in the receiver 180 and then flows out, and the refrigerant partially flows to the second suction return pipe 170*a* via the branching point B2 whereas the remaining thereof flows toward the liquid-refrigerant connection pipe 32. The refrigerant flowing from the receiver 180 to the liquid-refrigerant connection pipe 32 is cooled through heat exchange in the subcooling heat exchanger 170 with the refrigerant flowing through the second suction return pipe 170*a* toward the suction pipe 110*a* of the compressor 110, and then flows through the liquid-side shutoff valve 22 into the liquid-refrigerant connection pipe 32. The refrigerant flowing into the liquid-refrigerant connection pipe 32 via the liquid-side shutoff valve 22 joins the refrigerant flowing from the main liquid refrigerant pipe 252 in the connection unit 200B.

The refrigerant in the liquid-refrigerant connection pipe 32 is sent to the main liquid refrigerant pipe 252 in the connection unit 200A. The refrigerant sent to the main liquid refrigerant pipe 252 in the connection unit 200A is sent to the utilization flow-rate control valve 320 in the utilization unit 300A. The refrigerant sent to the utilization flow-rate control valve 320 in the utilization unit 300A is flow-rate controlled by the utilization flow-rate control valve 320 and is then evaporated to become a low-pressure gas refrigerant through heat exchange with indoor air supplied from the indoor fan in the utilization heat exchanger 310 of the utilization unit 300A. Meanwhile, the indoor air is cooled and is supplied into the room. The low-pressure gas refrigerant flowing out of the utilization heat exchanger 310 in the utilization unit 300A is sent to the joined gas refrigerant pipe 266 in the connection unit 200A. The low-pressure gas refrigerant sent to the joined gas refrigerant pipe 266 in the connection unit 200A is sent to the low-pressure gas-refrigerant connection pipe 36 via the low-pressure gas refrigerant pipe 264 in the connection unit 200A. The low-pressure gas refrigerant sent to the low-pressure gas-refrigerant connection pipe 36 returns to the suction side (the suction pipe 110*a*) of the compressor 110 via the low-pressure gas-side shutoff valve 26.

(b) Mainly with Radiation Load

Described below is operation of the air conditioner 10 during simultaneous cooling and heating operation with a superior radiation load of the utilization units 300. The utilization units 300 have a superior radiation load in an exemplary case where a large number of utilization units mostly execute heating operation and the remaining small number of the utilization units execute cooling operation. The following description relates to an exemplary case where there are provided only two utilization units 300 and the utilization unit 300B including the utilization heat exchanger 310 functioning as a radiator for a refrigerant has a heating load larger than a cooling load of the utilization unit 300A including the utilization heat exchanger 310 functioning as an evaporator for a refrigerant.

In this case, the control unit 400 switches the first flow path switching mechanism 132 into the evaporating operation state (the state indicated by the broken line of the first flow path switching mechanism 132 in FIG. 2) to cause the heat source-side heat exchanger 140 to function as an evaporator for a refrigerant. The control unit 400 further switches the second flow path switching mechanism 134 into the radiation load operation state (the state indicated by the broken line of the second flow path switching mechanism 134 in FIG. 2). The control unit 400 appropriately controls the opening degree of the heat source-side flow-rate control valve 150. The control unit 400 brings the high and low-pressure valve 230 into the closed state and brings the low pressure valve 240 into the opened state in the connection unit 200A, to cause the utilization heat exchanger 310 in the utilization unit 300A to function as an evaporator for a refrigerant. The control unit 400 appropriately controls the opening degree of the branching pipe control valve 220 in the connection unit 200A. The control unit 400 brings the branching pipe control valve 220 and the low pressure valve 240 into the closed state and brings the high and low-pressure valve 230 into the opened state in the connection unit 200B, to cause the utilization heat exchanger 310 in the utilization unit 300B to function as a radiator for a refrigerant. When the valves are controlled as described above in the connection units 200A and 200B, the utilization heat exchanger 310 in the utilization unit 300A and the suction side of the compressor 110 in the heat source unit 100A are connected via the low-pressure gas-refrigerant connection pipe 36. When the valves are controlled as described above in the connection units 200 A and 200B, the discharge side of the compressor 110 in the heat source unit 100A and the utilization heat exchanger 310 in the utilization unit 300B are connected via the high and low-pressure gas-refrigerant connection pipe 34. The control unit 400 appropriately controls the opening degrees of the utilization flow-rate control valves 320 in the utilization units 300A and 300B.

Figure 7D:
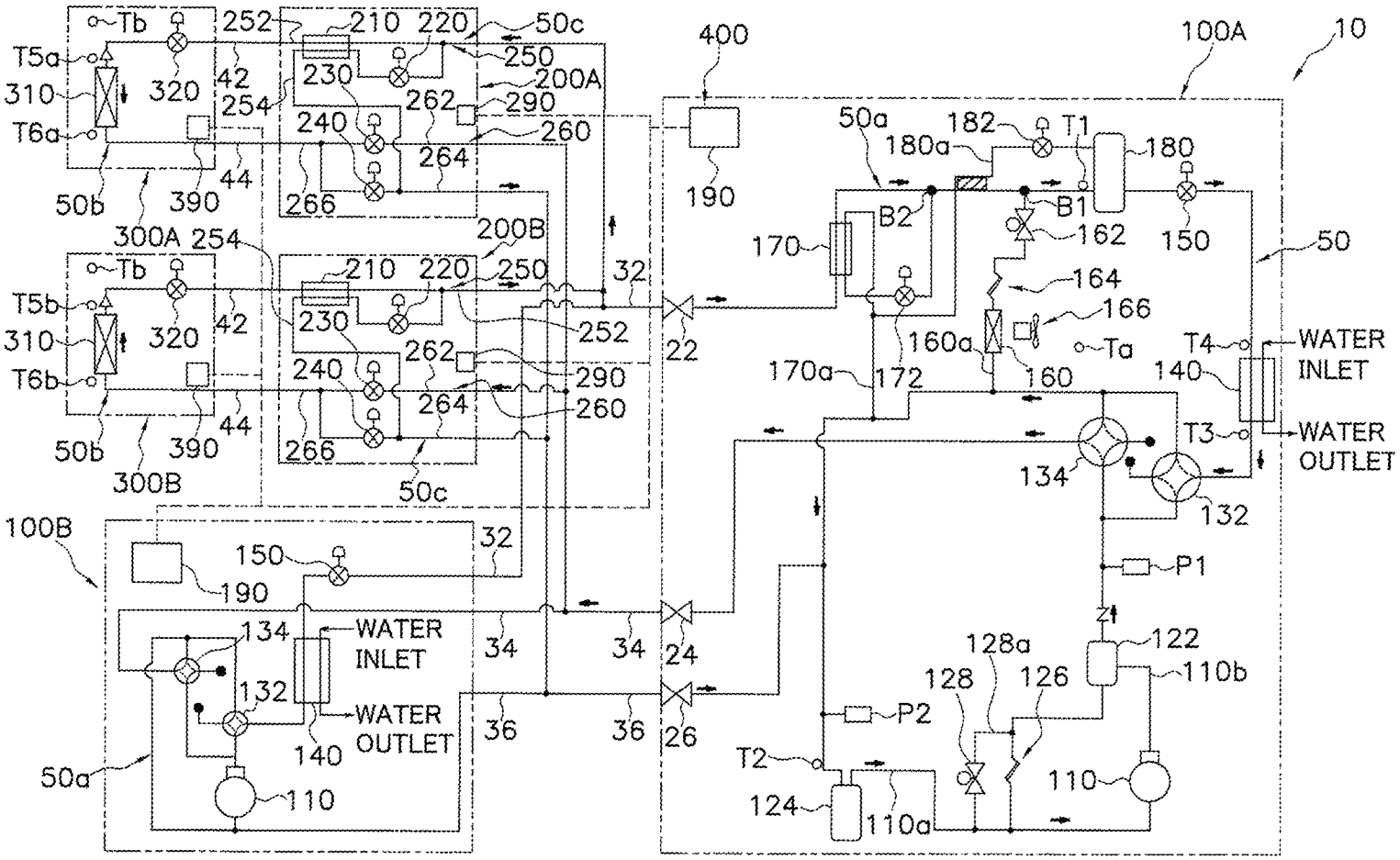
FIG. 7D is an explanatory diagram on a flow of the refrigerant in the refrigerant circuit in a case where one of the utilization units executes cooling operation and the other one of the utilization units executes heating operation in the air conditioner depicted in FIG. 1 mainly with a radiation load.

The control unit 400 operates the respective units in the air conditioner 10 as described above to allow the refrigerant to circulate in the refrigerant circuit 50 as indicated by arrows in FIG. 7D.

The high-pressure gas refrigerant compressed by and discharged from the compressor 110 is sent to the high and low-pressure gas-refrigerant connection pipe 34 via the second flow path switching mechanism 134 and the high and low-pressure gas-side shutoff valve 24. The high-pressure gas refrigerant sent to the high and low-pressure gas-refrigerant connection pipe 34 is sent to the high and low-pressure gas refrigerant pipe 262 in the connection unit 200B. The high-pressure gas refrigerant sent to the high and low-pressure gas refrigerant pipe 262 is sent to the utilization heat exchanger 310 in the utilization unit 300B via the high and low-pressure valve 230 and the joined gas refrigerant pipe 266. The high-pressure gas refrigerant sent to the utilization heat exchanger 310 in the utilization unit 300B radiates heat to be condensed through heat exchange with indoor air supplied from the indoor fan in the utilization heat exchanger 310. Meanwhile, the indoor air is heated and is supplied into the room. The refrigerant which radiated heat in the utilization heat exchanger 310 in the utilization unit 300B is flow-rate controlled by the utilization flow-rate control valve 320 in the utilization unit 300B and is then sent to the main liquid refrigerant pipe 252 in the connection unit 200B. The refrigerant sent to the main liquid refrigerant pipe 252 in the connection unit 200B is sent to the liquid-refrigerant connection pipe 32. The refrigerant in the liquid-refrigerant connection pipe 32 is partly sent to the main liquid refrigerant pipe 252 in the connection unit 200A and the remaining thereof is sent to the receiver 180 via the liquid-side shutoff valve 22.

The refrigerant sent to the main liquid refrigerant pipe 252 in the connection unit 200A partially flows to the branching liquid refrigerant pipe 254 and the remaining thereof flows toward the utilization flow-rate control valve 320 in the utilization unit 300A. The refrigerant flowing through the main liquid refrigerant pipe 252 toward the utilization flow-rate control valve 320 is cooled through heat exchange in the subcooling heat exchanger 210 with the refrigerant flowing through the branching liquid refrigerant pipe 254 toward the low-pressure gas refrigerant pipe 264, and then flows into the utilization flow-rate control valve 320. The refrigerant sent to the utilization flow-rate control valve 320 in the utilization unit 300A is flow-rate controlled by the utilization flow-rate control valve 320 in the utilization unit 300A and is then evaporated to become a low-pressure gas refrigerant through heat exchange with indoor air supplied from the indoor fan in the utilization heat exchanger 310 of the utilization unit 300A. Meanwhile, the indoor air is cooled and is supplied into the room. The low-pressure gas refrigerant flowing out of the utilization heat exchanger 310 is sent to the joined gas refrigerant pipe 266 in the connection unit 200A. The low-pressure gas refrigerant sent to the joined gas refrigerant pipe 266 flows into the low-pressure gas refrigerant pipe 264, and joins the refrigerant flowing from the branching liquid refrigerant pipe 254 to be sent to the low-pressure gas-refrigerant connection pipe 36. The low-pressure gas refrigerant sent to the low-pressure gas-refrigerant connection pipe 36 returns to the suction side (the suction pipe 110*a*) of the compressor 110 via the low-pressure gas-side shutoff valve 26.

The refrigerant sent from the liquid-refrigerant connection pipe 32 to the receiver 180 is temporarily stored in the receiver 180 and then flows out to be sent to the heat source-side flow-rate control valve 150. The refrigerant sent to the heat source-side flow-rate control valve 150 is evaporated to become a low-pressure gas refrigerant through heat exchange with water as the heat source in the heat source-side heat exchanger 140 and is sent to the first flow path switching mechanism 132. The low-pressure gas refrigerant sent to the first flow path switching mechanism 132 then returns to the suction side (the suction pipe 110*a*) of the compressor 110.

(4) CONTROL FOR COOLING INTERIOR OF CASING

Figure 8:
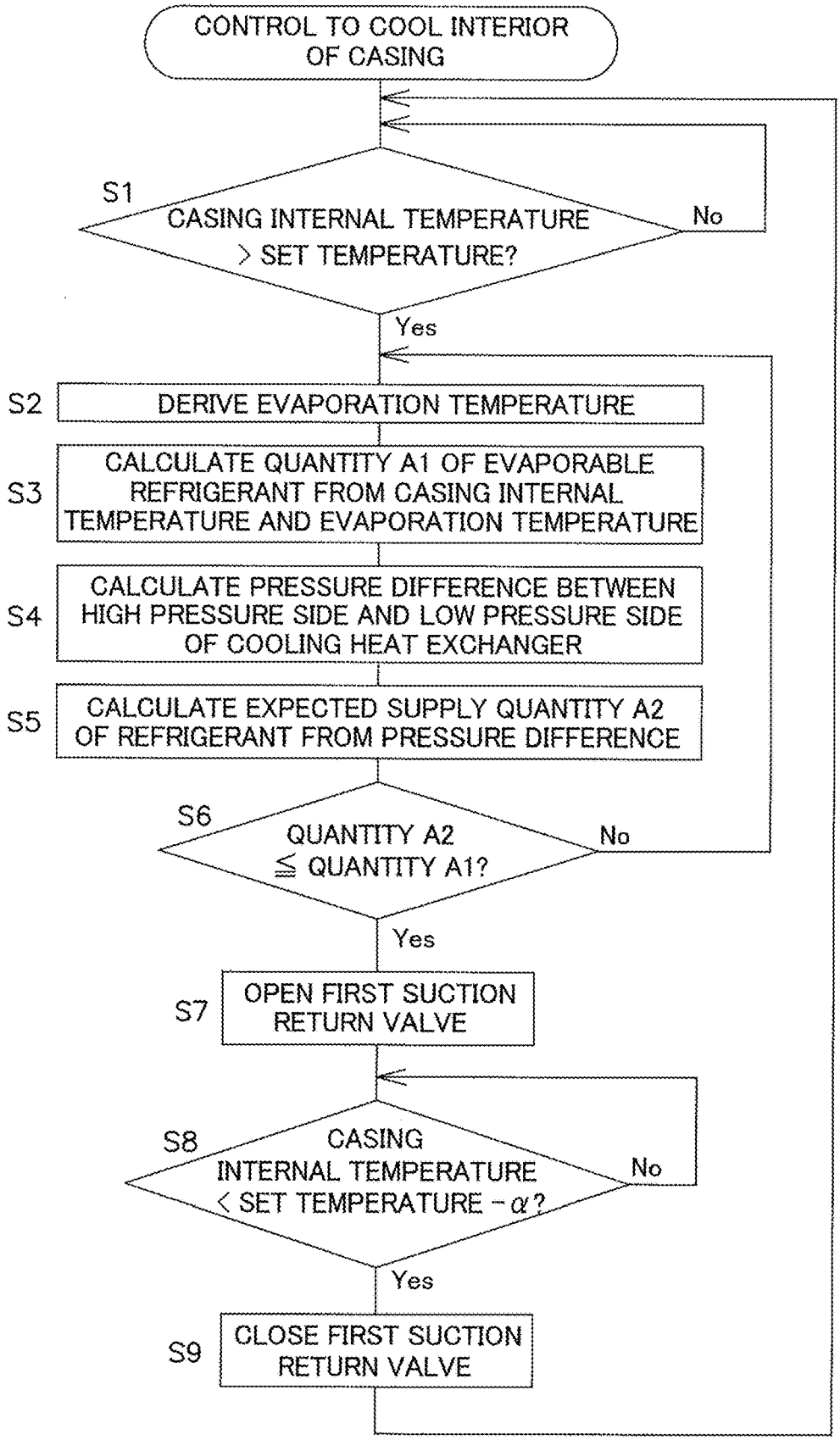
FIG. 8 is an explanatory flowchart of a flow of control to cool the interior of the casing by the control unit depicted in FIG. 5.

Control for cooling the interior of the casing 106 by the control unit 400 will be described next with reference to the flowchart in FIG. 8. Assume herein that the first suction return valve 162 is closed when step S1 described below starts.

The controller 406 initially determines whether or not the temperature in the casing 106 measured by the casing internal temperature sensor Ta is higher than the predetermined set temperature C2 (step S1). The set temperature C2 may have a value preliminarily stored in the storage unit 410 of the control unit 400, or a value set by the user of the air conditioner 10 with use of the operation unit (not depicted) of the air conditioner 10. The process proceeds to step S2 if the temperature in the casing 106 measured by the casing internal temperature sensor Ta is higher than the predetermined set temperature C2. Step S1 is repeated until the temperature in the casing 106 measured by the casing internal temperature sensor Ta is determined as being higher than the predetermined set temperature C2.

Subsequently in step S2, the controller 406 calculates the evaporation temperature in the refrigeration cycle in accordance with the information on the relation between temperature and pressure of a refrigerant stored in the storage unit 410 of the control unit 400 and a value of the low pressure in the refrigeration cycle measured by the low pressure sensor P2.

Subsequently in step S3, the controller 406 calculates the quantity A1 of the liquid refrigerant evaporable in the cooling heat exchanger 160 when the refrigerant is supplied to the cooling heat exchanger 160, in accordance with the evaporation temperature in the refrigeration cycle calculated in step S2, the temperature in the casing 106 measured by the casing internal temperature sensor Ta, and the information on the relation between quantity of the refrigerant evaporable in the cooling heat exchanger 160 and air temperature in the casing 106 at different evaporation temperature levels in the refrigeration cycle as stored in the storage unit 410 of the control unit 400.

Subsequently in step S4, the controller 406 calculates the pressure difference ΔP between the first pressure Pr1 and the second pressure Pr2 using the first pressure Pr1 derived by the first deriving unit 402 and the second pressure Pr2 derived by the second deriving unit 404.

Subsequently in step S5, the controller 406 calculates the quantity A2 (flow rate) of the refrigerant expected to be supplied to the cooling heat exchanger 160 when the first suction return valve 162 is opened, in accordance with the pressure difference ΔP calculated in step S4 and the information on the relation between pressure difference and a flow rate of a liquid refrigerant as stored in the storage unit 410 of the control unit 400.

Subsequently in step S6, the controller 406 compares the quantity A1 of the liquid refrigerant evaporable in the cooling heat exchanger 160 when the refrigerant is supplied to the cooling heat exchanger 160 and the quantity A2 of the refrigerant expected to be supplied to the cooling heat exchanger 160 when the first suction return valve 162 is opened. The process proceeds to step S7 if the quantity A2 the quantity A1 is established. If the quantity A2>the quantity A1 is established, the controller 406 keeps the first suction return valve 162 closed (i.e. does not open the first suction return valve 162), and the process returns to step S2.

In step S7, the controller 406 opens the first suction return valve 162. The process subsequently proceeds to step S8.

In step S8, the controller 406 determines whether or not the temperature in the casing 106 measured by the casing internal temperature sensor Ta is less than a value obtained by subtracting a value a from the set temperature C2. The value a has a predetermined positive value. Although the value a may alternatively be zero, the value a having an appropriate positive value leads to inhibiting the first suction return valve 162 from frequently opening and closing. When the temperature in the casing 106 is less than the value obtained by subtracting the value a from the set temperature C2, the process proceeds to step S9. The processing in step S8 is repeated until the temperature in the casing 106 is assessed as being less than the value obtained by subtracting the value a from the set temperature C2.

In step S9, the controller 406 closes the first suction return valve 162. The process subsequently returns to step S1.

(5) CONTROL FOR INHIBITING DEW CONDENSATION AND FREEZING AT UTILIZATION UNIT

Figure 9:
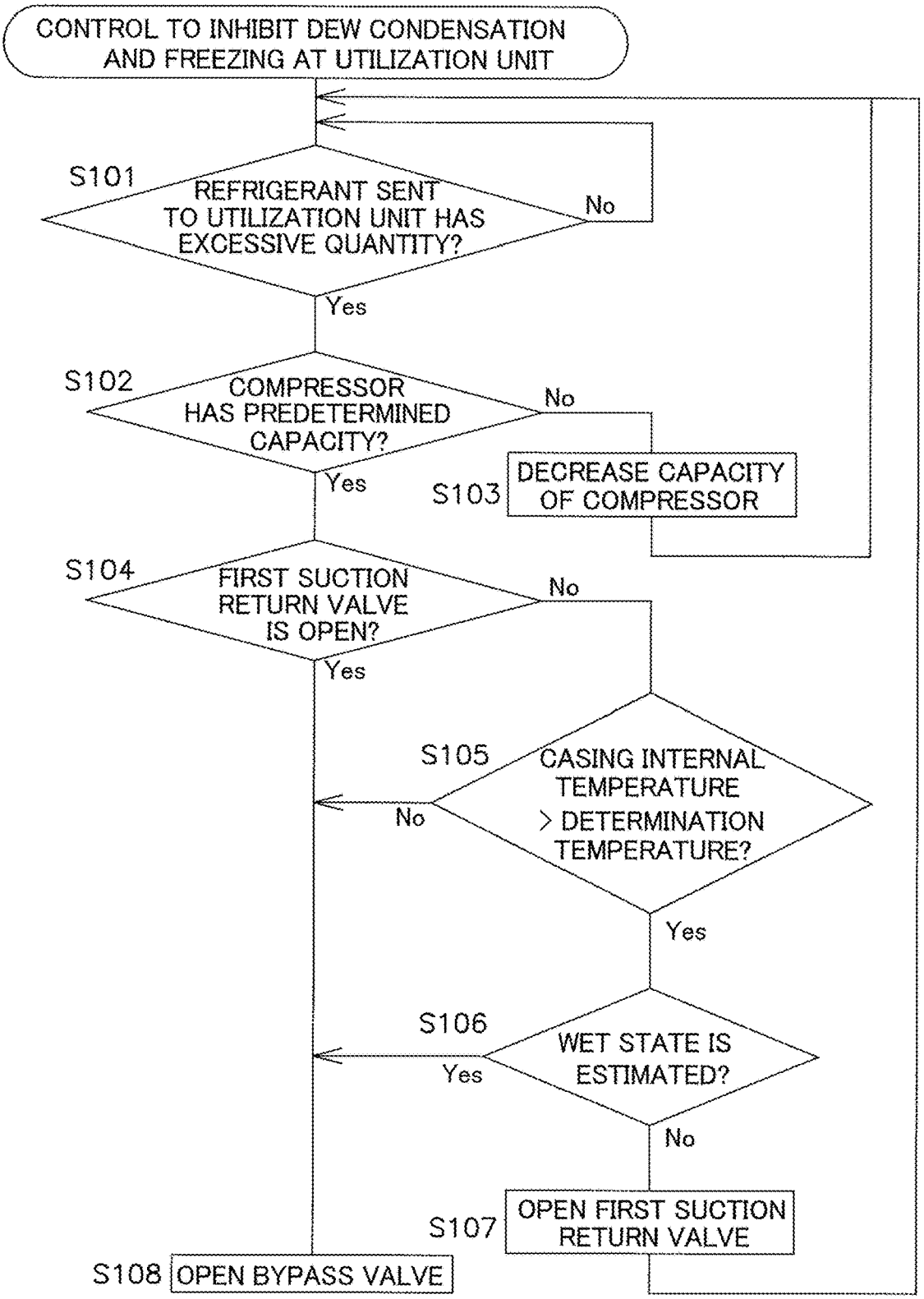
FIG. 9 is an explanatory flowchart of a flow of control to reduce the occurrence of dew condensation and freezing at the utilization unit by the control unit depicted in FIG. 5.

Described below with reference to a flowchart in FIG. 9 is control to inhibit dew condensation and freezing at the utilization unit 300 by the control unit 400. For simplified description, the following description does not assume simultaneous execution of control to inhibit dew condensation and freezing at the utilization unit 300 and control to cool the interior of the casing 106.

The controller 406 preferably opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity even when the casing interior cooling mode is not selected as the operating mode to be adopted. Further, the controller 406 preferably opens the first suction return valve 162 to supply the cooling heat exchanger 160 with the refrigerant to cause the cooling heat exchanger 160 to function as a heat absorber when the casing interior cooling mode is selected as the operating mode to be adopted and the controller 406 assesses that the refrigerant sent to the utilization unit 300 needs to be decreased in quantity, even when the temperature in the casing 106 measured by the casing internal temperature sensor Ta is lower than the set temperature C2 (assuming that determination temperature C1 to be mentioned later is lower than the set temperature C2 in this case).

In other words, the controller 406 preferably opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity during cooling operation in which the heat source-side heat exchanger 140 functions as a radiator, independently from adoption of the casing interior cooling mode.

The controller 406 assesses whether or not the refrigerant sent to the utilization unit 300 has excessive quantity in accordance with the pressure measured by the low pressure sensor P2, the temperature measured by the liquid-side temperature sensor T5*a* or T5*b*, or the temperature measured by the space temperature sensor Tb, as described above, during cooling operation in which the heat source-side heat exchanger 140 functions as a radiator (condenser) (step S101). The process proceeds to step S102 when the controller 406 assesses that the refrigerant sent to the utilization unit 300 has excessive quantity. The processing in step S101 is repeated until the refrigerant sent to the utilization unit 300 is assessed as having excessive quantity during cooling operation in which the heat source-side heat exchanger 140 functions as a radiator (condenser).

Subsequently in step S102, the controller 406 assesses whether or not the capacity of the compressor 110 is equal to the predetermined capacity. The predetermined capacity is equal to the minimum capacity of the compressor 110 in this embodiment. The present invention should not be limited to this case, but the predetermined capacity may alternatively have capacity different from the minimum capacity of the compressor 110 and be less than a predetermined threshold. The process proceeds to step S104 in a case where the capacity of the compressor 110 is equal to the predetermined capacity. The process proceeds to step S103 in another case where the capacity of the compressor 110 is not equal to the predetermined capacity (when the capacity of the compressor 110 is not equal to the minimum capacity or is not less than the predetermined threshold).

In step S103, the controller 406 decreases the capacity of the compressor 110. The capacity of the compressor 110 may be decreased by a predetermined value or may be decreased to reach a value according to measurement values of the various sensors.

In step S104, the controller 406 assesses whether or not the first suction return valve 162 is open. The process proceeds to step S108 in a case where the first suction return valve 162 is open, whereas the process proceeds to step S105 in another case where the first suction return valve 162 is closed.

In step S105, the controller 406 assesses whether or not the temperature measured by the casing internal temperature sensor Ta is higher than the determination temperature C1 exemplifying first predetermined temperature. The process proceeds to step S106 in a case where the temperature measured by the casing internal temperature sensor Ta is higher than the determination temperature C1. The process proceeds to step S108 in another case where the temperature measured by the casing internal temperature sensor Ta is equal to or less than the determination temperature C1. The determination temperature C1 may have a value appropriate for the cooling heat exchanger 160 to function as a heat absorber. Such determination processing inhibits the cooling heat exchanger 160 from functioning as a heat absorber even when the temperature in the casing 106 is too low (for the cooling heat exchanger 160 to function as a heat absorber).

The processing in step S105 may be omitted appropriately. For example, the processing in step S105 may not be executed when the temperature in the casing 106 is found to be constantly rather high.

In step S106, the controller 406 assesses, before the first suction return valve 162 is opened to supply the cooling heat exchanger 160 with the refrigerant, whether or not the refrigerant flowing from the cooling heat exchanger 160 toward the compressor 110 comes into the wet state when the refrigerant is supplied to the cooling heat exchanger 160, and determines whether or not to open the first suction return valve 162 in accordance with an assessment result. The processing in step S106, which will not be described herein, is similar to the processing from step S2 to step S6 in control for cooling the interior of the casing 106 by the control unit 400. The process proceeds to step S108 in a case where, in step S106, the refrigerant flowing from the cooling heat exchanger 160 toward the compressor 110 is assessed as coming into the wet state when the refrigerant is supplied to the cooling heat exchanger 160. The process proceeds to step S107 in another case where the refrigerant is assessed as not coming into the wet state.

In step S107, the controller 406 opens the first suction return valve 162. The process subsequently returns to step S101.

In step S108, the controller 406 opens the bypass valve 128.

Though not described in detail herein, when assessing that the refrigerant sent to the utilization unit 300 needs to be increased in quantity, the controller 406 controls the compressor 110, the first suction return valve 162, and the bypass valve 128 in the following exemplary manner.

If the bypass valve 128 is open, the controller 406 preferentially controls to close the bypass valve 128 before controlling the compressor 110 and the first suction return valve 162. If the bypass valve 128 is closed and the first suction return valve 162 is open, the controller 406 preferentially closes the first suction return valve 162 before controlling the compressor 110. If the bypass valve 128 and the first suction return valve 162 are both closed, the controller 406 controls to increase the capacity of the compressor 110.

(6) CHARACTERISTICS (6-1)

The air conditioner 10 exemplifying the refrigeration apparatus according to the embodiment described above includes the heat source unit 100, the utilization unit 300, and the controller 406. The heat source unit 100 includes the compressor 110, the heat source-side heat exchanger 140 exemplifying the first heat exchanger, the cooling heat exchanger 160 exemplifying the second heat exchanger, the casing 106, and the first suction return valve 162. The compressor 110 compresses a refrigerant. The heat source-side heat exchanger 140 causes heat exchange between the refrigerant and the liquid fluid. The cooling heat exchanger 160 causes heat exchange between the refrigerant and air. The casing 106 accommodates the compressor 110, the heat source-side heat exchanger 140, and the cooling heat exchanger 160. The first suction return valve 162 switches to supply or not to supply the cooling heat exchanger 160 with the refrigerant. The utilization unit 300 includes the utilization heat exchanger 310. The utilization unit 300 and the heat source unit 100 constitute the refrigerant circuit 50. The controller 406 controls to operate the compressor 110 and to open or close the first suction return valve 162. The controller 406 opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity during cooling operation in which the heat source-side heat exchanger 140 functions as a radiator.

In this case, when the refrigerant sent from the heat source unit 100 to the utilization unit 300 needs to be decreased in quantity during operation in which the heat source-side heat exchanger 140 (a liquid fluid heat exchanger) functions as a radiator, the refrigerant is sent to the cooling heat exchanger 160 (an air heat exchanger) to cause the cooling heat exchanger 160 to function as a heat absorber. This configuration can reduce the occurrence of excessive cooling capability in the utilization unit 300 to reduce the occurrence of dew condensation at the utilization unit 300 and freezing at the utilization heat exchanger 310.

The heat source unit 100 using the liquid fluid (water in this case) as a heat source is often disposed in a room and is likely to have increase in internal temperature of the casing 106 due to heat generated from equipment such as the compressor 110 and the electric components 104 during operation of the air conditioner 10. In other words, the casing 106 often has relatively high internal temperature. In contrast, the present configuration achieves suppression of excessive cooling capability of the utilization unit 300 as well as suppression of excessive temperature increase in the casing 106 by means of the cooling heat exchanger 160 functioning as a heat absorber. Particularly in a case where the heat source unit 100 is installed in a room like the machine chamber, air warmed in the casing 106 blows into the machine chamber that also has temperature increase to adversely affect a work environment and the like for a worker in the machine chamber. The cooling heat exchanger 160 operating as a heat absorber can reduce the occurrence of such problems.

(6-2)

In the air conditioner 10 according to the above embodiment, the compressor 110 has variable capacity. The controller 406 opens the first suction return valve 162 to supply the cooling heat exchanger 160 with the refrigerant to cause the cooling heat exchanger 160 to function as a heat absorber when assessing that the refrigerant sent to the utilization unit 300 needs to be further decreased in quantity after the capacity of the compressor 110 is decreased to the predetermined capacity during cooling operation in which the heat source-side heat exchanger 140 functions as a radiator.

In this case, the capacity of the compressor 110 is initially decreased to the predetermined capacity. This configuration can energetically efficiently reduce the occurrence of excessive cooling capability to reduce the occurrence of dew condensation at the utilization unit 300 and freezing at the utilization heat exchanger 310.

(6-3)

In the air conditioner 10 according to the above embodiment, the controller 406 assesses that the refrigerant sent to the utilization unit 300 needs to be decreased in quantity when the low pressure in the refrigeration cycle decreases to become equal to or less than the predetermined threshold or when the low pressure in the refrigeration cycle is assessed to decrease to become equal to or less than the predetermined threshold.

In this case, the cooling heat exchanger 160 is supplied with the refrigerant to function as a heat absorber when the low pressure (suction pressure) in the refrigeration cycle becomes or is expected to become equal to or less than the predetermined threshold. This configuration can reduce the occurrence of excessive cooling capability of the utilization unit 300 to reduce the occurrence of dew condensation at the utilization unit 300 and freezing at the utilization heat exchanger 310.

(6-4)

In the air conditioner 10 according to the above embodiment, the controller 406 assesses whether or not the refrigerant sent to the utilization unit 300 needs to be decreased in quantity in accordance with the state of the utilization unit 300.

In this case, whether or not to supply the cooling heat exchanger 160 with the refrigerant is determined in accordance with the state of the utilization unit 300. This configuration can easily reduce the occurrence of excessive cooling capability of the utilization unit 300 to reduce the occurrence of dew condensation at the utilization unit 300 and freezing at the utilization heat exchanger 310.

(6-5)

The air conditioner 10 according to the above embodiment includes the liquid-side temperature sensor T5*a* or T5*b* configured to measure temperature of the refrigerant flowing in the utilization heat exchanger 310. The controller 406 assesses whether or not the refrigerant sent to the utilization unit 300 needs to be decreased in quantity in accordance with the temperature measured by the liquid-side temperature sensor T5*a* or T5*b*.

In this case, whether or not to supply the cooling heat exchanger 160 with the refrigerant is determined in accordance with the temperature of the refrigerant flowing in the utilization heat exchanger 310. This configuration can easily reduce the occurrence of excessive cooling capability of the utilization unit 300 to reduce the occurrence of dew condensation at the utilization unit 300 and freezing at the utilization heat exchanger 310.

(6-6)

The air conditioner 10 according to the above embodiment includes the space temperature sensor Tb and the storage unit 410. The space temperature sensor Tb measures temperature in the temperature adjustment target space of the utilization unit 300. The storage unit 410 stores the target temperature in the temperature adjustment target space of the utilization unit 300. The controller 406 assesses whether or not the refrigerant sent to the utilization unit 300 needs to be decreased in quantity in accordance with the temperature in the space measured by the space temperature sensor Tb and the target temperature in the space stored in the storage unit 410.

In this case, whether or not to supply the cooling heat exchanger 160 with the refrigerant is determined in accordance with the temperature in the cooling target space of the utilization unit 300 and the target temperature. This configuration can easily reduce the occurrence of excessive cooling capability of the utilization unit 300 to reduce the occurrence of dew condensation at the utilization unit 300 and freezing at the utilization heat exchanger 310.

(6-7)

The air conditioner 10 according to the above embodiment includes the bypass pipe 128*a* and the bypass valve 128. The bypass pipe 128*a* connects the suction pipe 110*a* and the discharge pipe 110*b* of the compressor 110. The bypass valve 128 is provided on the bypass pipe 128*a*. The controller 406 controls operation of the bypass valve 128. The controller 406 controls to open the bypass valve 128 when assessing that the refrigerant sent to the utilization unit 300 needs to be further decreased in quantity after the cooling heat exchanger 160 functions as a heat absorber during cooling operation.

In this case, the refrigerant sent to the utilization unit 300 can be further decreased in quantity by causing the refrigerant discharged from the compressor 110 to partially pass through the bypass pipe 128*a* when the cooling capability is still excessive even when the cooling heat exchanger 160 operates.

(6-8)

The air conditioner 10 according to the above embodiment includes the casing internal temperature sensor Ta configured to measure temperature in the casing 106. The controller 406 opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity and the temperature in the casing 106 measured by the casing internal temperature sensor Ta is higher than the determination temperature C1. The determination temperature C1 exemplifies the first predetermined temperature.

In this case, the cooling heat exchanger 160 is supplied with the refrigerant when it is assessed that the refrigerant sent to the utilization unit 300 needs to be decreased in quantity and also the temperature in the casing 106 is higher than the determination temperature C1. This configuration can achieve the highly reliable air conditioner 10 that controls not to supply the cooling heat exchanger 160 with the refrigerant when air temperature in the casing 106 is low and there is a possibility that the refrigerant in the wet state is sent to the compressor 110 from the cooling heat exchanger 160 and liquid compression is therefore be caused.

(6-9)

The air conditioner 10 according to the above embodiment includes the casing internal temperature sensor Ta configured to measure temperature in the casing 106. The controller 406 has the casing interior cooling mode as a selectively adoptable operating mode. In the casing interior cooling mode, the controller 406 opens the first suction return valve 162 to supply the cooling heat exchanger 160 with the refrigerant to cause the cooling heat exchanger 160 to function as a heat absorber when the temperature in the casing 106 measured by the casing internal temperature sensor Ta is higher than the set temperature C2. The set temperature C2 exemplifies the second predetermined temperature. The controller 406 opens the first suction return valve 162 to supply the cooling heat exchanger 160 with the refrigerant to cause the cooling heat exchanger 160 to function as a heat absorber when assessing that the refrigerant sent to the utilization unit 300 needs to be decreased in quantity during cooling operation, even when the casing interior cooling mode is not selected as an operating mode to be adopted.

In this case, even when the casing interior cooling mode is not selected as the operating mode, the air conditioner operates to cause the cooling heat exchanger 160 function as a heat absorber to achieve protective control of inhibiting dew condensation at the utilization unit 300 and freezing at the utilization heat exchanger 310. The air conditioner 10 thus achieves high reliability.

(6-10)

In the air conditioner 10 according to the above embodiment, the first suction return valve 162 is opened to supply the cooling heat exchanger 160 with the refrigerant to cause the cooling heat exchanger 160 to function as a heat absorber when assessing that the refrigerant sent to the utilization unit 300 needs to be decreased in quantity during cooling operation and the casing interior cooling mode is selected as the operating mode to be adopted, even when the temperature in the casing 106 measured by the casing internal temperature sensor Ta is lower than the set temperature C2.

In this case, even when not satisfying under a condition for executing the casing interior cooling mode, the air conditioner operates with the cooling heat exchanger 160 functioning as a heat absorber to achieve protective control of inhibiting dew condensation at the utilization unit 300 and freezing at the utilization heat exchanger 310. The air conditioner 10 thus achieves high reliability.

(6-11)

In the air conditioner 10 according to the above embodiment, the predetermined capacity is the minimum capacity of the compressor 110.

In this case, even when the compressor 110 cannot be further decreased in capacity, it is possible to reduce the occurrence of excessive cooling capability of the utilization unit 300 to reduce the occurrence of dew condensation at the utilization unit 300 and freezing at the utilization heat exchanger 310 by functioning the cooling heat exchanger 160 as a heat absorber.

(7) MODIFICATION EXAMPLES

The modification examples of the above embodiment will be described hereinafter. Any of the following modification examples may be combined where appropriate within a range causing no contradiction.

(7-1) Modification Example A

In step S106 in the flowchart of control for inhibiting dew condensation and freezing at the utilization unit, the controller 406 according to the above embodiment assesses whether or not the refrigerant immediately after flowing out of the cooling heat exchanger 160 entirely comes into the gaseous state when the refrigerant is supplied to the cooling heat exchanger 160, and determines whether or not to open the first suction return valve 162 in accordance with an assessment result. The aspects of the present invention should not be limited to such an aspect.

For example, if the refrigerant that is obtained after mixing the refrigerant flowing out of the cooling heat exchanger 160 and the refrigerant returning from the utilization unit 300 and that flows toward the compressor 110 is assessed as not coming into the wet state, the controller 406 may assess that the refrigerant flowing from the cooling heat exchanger 160 toward the compressor 110 does not come into the wet state even in a case where the refrigerant is supplied to the cooling heat exchanger 160 and the refrigerant immediately after flowing out of the cooling heat exchanger 160 is assessed as not entirely coming into the gaseous state (as coming into the wet state).

(7-2) Modification Example B

In step S106 in the flowchart of control for inhibiting dew condensation and freezing at the utilization unit 300, the controller 406 according to the above embodiment assesses whether or not the refrigerant immediately after flowing out of the cooling heat exchanger 160 entirely comes into the gaseous state when the refrigerant is supplied to the cooling heat exchanger 160, and determines whether or not to open the first suction return valve 162 in accordance with an assessment result. The aspects of the present invention should not be limited to such an aspect.

For example, the controller 406 may not execute the processing in step S106 in the flowchart of control for inhibiting dew condensation and freezing at the utilization unit. For example, the controller 406 may readily open the first suction return valve 162 when the temperature in the casing 106 is assessed as being higher than the determination temperature C1 in step S105.

(7-3) Modification Example C

When assessing that the refrigerant sent to the utilization unit 300 needs to be decreased in quantity, the controller 406 according to the above embodiment controls the compressor 110, the first suction return valve 162, and the bypass valve 128 generally in the order of decreasing the capacity of the compressor 110 to the predetermined capacity, opening the first suction return valve 162, and then opening the bypass valve 128. The aspects of the present invention should not be limited to such an aspect.

For example, the controller 406 may alternatively open the bypass valve 128 after decreasing the capacity of the compressor 110 to the predetermined capacity, and open the first suction return valve 162 when the refrigerant sent to the utilization unit 300 still needs to be further decreased in quantity.

(7-4) Modification Example D

The controller 406 according to the above embodiment controls operation of the bypass valve 128 in addition to the compressor 110 and the first suction return valve 162 when assessing that the refrigerant sent to the utilization unit 300 needs to be decreased in quantity. The aspects of the present invention should not be limited to such an aspect.

For example, the air conditioner 10 may not include the bypass pipe 128*a* or the valve 128. In this case, the controller 406 may control the capacity of the compressor 110 and operation of the first suction return valve 162.

(7-5) Modification Example E

The controller 406 according to the above embodiment controls to open or close the first suction return valve 162. In a case where the first suction return pipe 162*a* is provided with a motor valve having a controllable opening degree in place of the first suction return valve 162 and the capillary 164, the controller 406 may appropriately control the opening degree of the motor valve in addition to control to open or close the motor valve as control to inhibit dew condensation and freezing at the utilization unit 300.

(7-6) Modification Example F

The air conditioner 10 according to the above embodiment includes the connection units 200, to allow part of the utilization units 300 to execute cooling operation and allow the remaining utilization unit 300 to execute heating operation. The present invention should not be limited to this configuration. The air conditioner exemplifying the refrigeration apparatus according to the present invention may not be configured to execute simultaneous cooling and heating operation.

The air conditioner 10 may still alternatively be configured to dedicatedly execute cooling operation.

(7-7) Modification Example G

The cooling heat exchanger 160 according to the above embodiment is supplied with air having cooled the electric components 104. The present invention should not be limited to this configuration. The air conditioner 10 may further include a fan provided separately from the fan 166 configured to guide air to the electric components 104, and the fan may be configured to supply the cooling heat exchanger 160 with air in the casing 106.

Furthermore, the cooling heat exchanger 160 may not be configured to decrease temperature in the casing 106.

(7-8) Modification Example H

The air conditioner 10 according to the above embodiment includes the refrigerant having phase change. The present invention should not be limited to this configuration. The refrigerant included in the air conditioner 10 may alternatively be a refrigerant having no phase change and exemplified by carbon dioxide.

(7-9) Modification Example I

The controller 406 according to the above embodiment opens the first suction return valve 162 to supply the cooling heat exchanger 160 with the refrigerant to cause the cooling heat exchanger 160 to function as a heat absorber when assessing that the refrigerant sent to the utilization unit 300 needs to be further decreased in quantity after the capacity of the compressor 110 is decreased to the predetermined capacity during cooling operation in which the heat source-side heat exchanger 140 functions as a radiator. Control by the controller 406 should not be limited to such an aspect.

Figure 10:
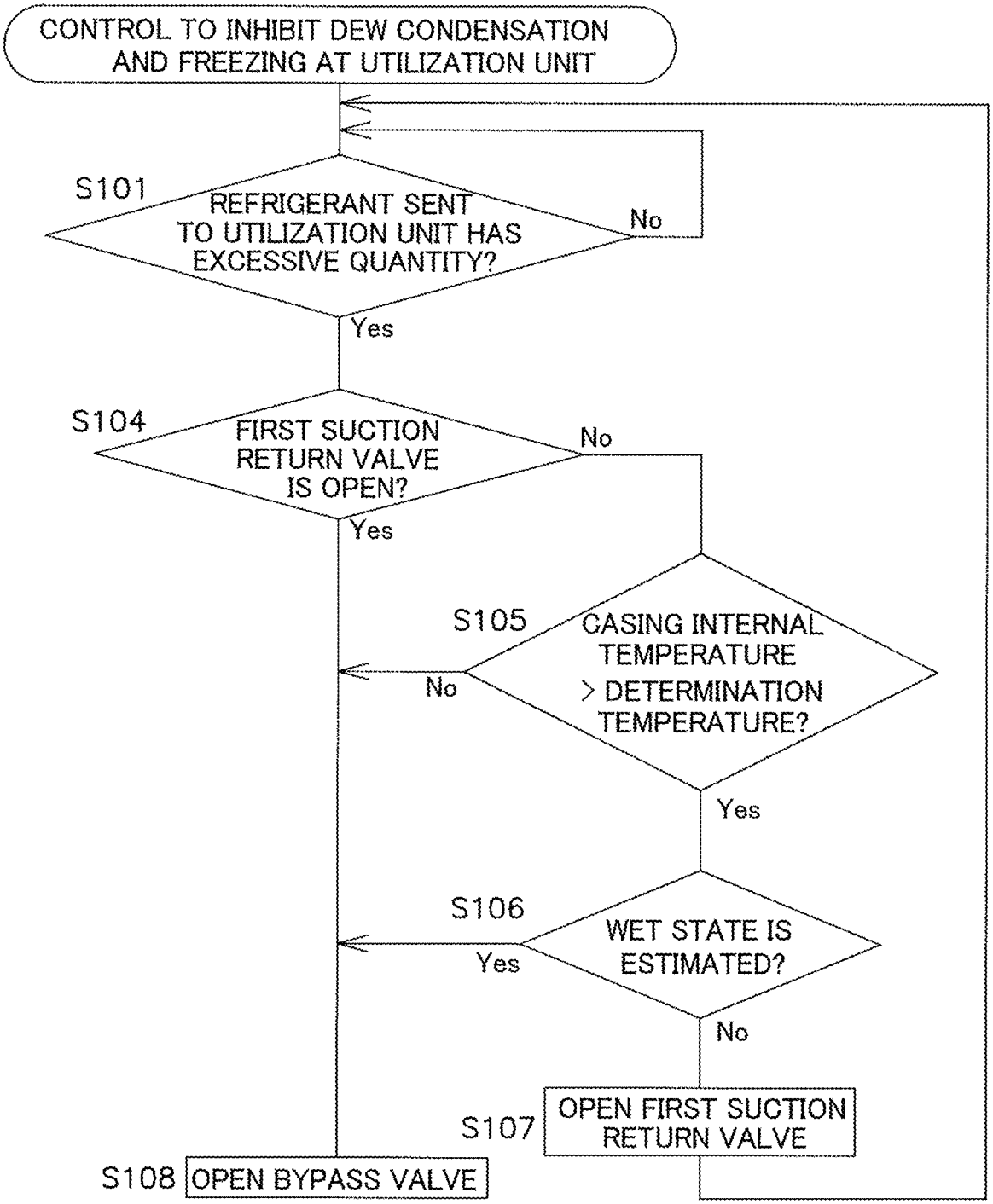
FIG. 10 is an explanatory flowchart of a flow of control to reduce the occurrence of dew condensation and freezing at the utilization unit according to a modification example I.

When assessing that the refrigerant sent to the utilization unit 300 needs to be decreased in quantity as in the flowchart in FIG. 10 (Yes in step S101), the controller 406 may, without controlling to decrease the capacity of the compressor 110, open the first suction return valve 162 to supply the cooling heat exchanger 160 with the refrigerant to cause the cooling heat exchanger 160 to function as a heat absorber. In this case, similarly to the processing from step S104 to step S108 in the flowchart in FIG. 9, the controller 406 may open the bypass valve 128 when the first suction return valve 162 is already open or when some trouble is expected by opening the first suction return valve 162 (see FIG. 10). Processing in step S101 and processing from step S104 to step S108 in the flowchart in FIG. 10, which will not be described herein, are similar to the processing in step S101 and the processing from step S104 to step S108 in the flowchart in FIG. 9.

Control according to the flowchart in FIG. 10 is executed to achieve the following effects.

The capacity of the compressor 110 cannot be instantaneously changed due to characteristics of the compressor 110. It takes some time to decrease the capacity of the compressor 110 to the predetermined capacity in the case where the compressor 110 in operation has capacity larger than the predetermined capacity. In control to decrease the capacity of the compressor 110 to the predetermined capacity, the utilization unit 300 may be supplied with an excessive refrigerant until the control of the capacity of the compressor 110 completes even if the load of the utilization unit 300 and capability of the heat source unit 100 can be balanced only through control of the capacity of the compressor 110.

In contrast, a state of sending an excessive refrigerant to the utilization unit 300 can be inhibited from lasting by initially opening the first suction return valve 162 to cause the cooling heat exchanger 160 to function as a heat absorber when it is assessed that the refrigerant sent to the utilization unit 300 needs to be decreased in quantity.

If Yes in step S101, the controller 406 preferably controls to decrease the capacity of the compressor 110 along with control according to the flowchart in FIG. 10. When assessing that the refrigerant sent to the utilization unit 300 needs to be increased in quantity after the first suction return valve 162 is opened and the capacity of the compressor 110 is controlled to reach the predetermined capacity, the controller 406 may preferentially control to close the first suction return valve 162 before controlling to increase the capacity of the compressor 110. Such control leads to prompt cancellation of the state of sending an excessive refrigerant to the utilization unit 300 and eventually decrease in capacity of the compressor 110, for achievement of excellent control also in terms of energy saving.

The controller 406 may selectively execute the processing according to the flowchart in FIG. 9 or the processing according to the flowchart in FIG. 10.

For example, the controller 406 may execute the processing according to the flowchart in FIG. 10 in a case with a high degree of urgency (where the refrigerant sent to the utilization unit 300 needs to be immediately decreased in quantity), or may execute the processing according to the flowchart in FIG. 9 in another case with a low degree of urgency. Specifically, the controller 406 may execute the processing according to the flowchart in FIG. 10, assessing that the refrigerant sent to the utilization unit 300 needs to be decreased in quantity with a high degree of urgency in an exemplary case where the low pressure in the refrigeration cycle decreases to become equal to or less than a predetermined first threshold. The controller 406 may execute the processing according to the flowchart in FIG. 9, assessing that the refrigerant sent to the utilization unit 300 needs to be decreased in quantity with a low degree of urgency in another exemplary case where the low pressure in the refrigeration cycle is more than the predetermined first threshold and not more than a second threshold (>the first threshold).

The storage unit 410 in the control unit 400 according to a different configuration may store data on time necessary for decreasing the capacity of the compressor 110 from certain capacity to the predetermined capacity. The controller 406 may calculate time for achievement of decrease the capacity of the compressor 110 to the predetermined capacity in accordance with the data stored in the storage unit 410 and current capacity of the compressor 110, and may execute the processing according to the flowchart in FIG. 10 in a case where the time is longer than predetermined time or execute the processing according to the flowchart in FIG. 9 in another case where the time is shorter than the predetermined time.

INDUSTRIAL APPLICABILITY

The present invention provides a highly reliable refrigeration apparatus that can reduce the occurrence of dew condensation and freezing at a utilization unit.

REFERENCE SIGNS LIST

10 air conditioner (refrigeration apparatus)
50 refrigerant circuit
100 (100A, 100B) heat source unit
106 casing
110 compressor
110*a* suction pipe (suction tube)
110*b* discharge pipe (discharge tube)
128 bypass valve
128*a* bypass pipe
140 heat source-side heat exchanger (first heat exchanger)
160 cooling heat exchanger (second heat exchanger)
162 first suction return valve (valve)
300 (300A, 300B) utilization unit
310 utilization heat exchanger
406 controller
410 storage unit
Ta casing internal temperature sensor (casing internal temperature measurement unit)
Tb space temperature sensor (space temperature measurement unit)
T5*a*, T5*b* liquid-side temperature sensor (temperature measurement unit)
C1 determination temperature (first predetermined temperature)
C2 set temperature (second predetermined temperature)

CITATION LIST

Patent Literature

Patent Literature 1: JP 2016-191505 A

The invention claimed is:

1. A refrigeration apparatus comprising:

a heat source unit including a compressor configured to compress a refrigerant, a first heat exchanger configured to cause heat exchange between the refrigerant and liquid fluid, a second heat exchanger configured to cause heat exchange between the refrigerant and air, a casing accommodating the compressor, the first heat exchanger, and the second heat exchanger, and a valve configured to switch to supply or not to supply the second heat exchanger with the refrigerant;

a utilization unit including a utilization heat exchanger, the utilization unit and the heat source unit constituting a refrigerant circuit; and a controller configured to control to operate the compressor and open or close the valve, wherein the controller is configured to open the valve to supply the second heat exchanger with the refrigerant to cause the second heat exchanger to function as a heat absorber when assessing that the refrigerant sent to the utilization unit needs to be decreased in quantity during cooling operation in which the first heat exchanger functions as a radiator, the compressor has variable capacity, and the controller is configured to open the valve to supply the second heat exchanger with the refrigerant to cause the second heat exchanger to function as a heat absorber when assessing that the refrigerant sent to the utilization unit needs to be further decreased in quantity after the capacity of the compressor is decreased to predetermined capacity during the cooling operation in which the first heat exchanger functions as a radiator.

2. The refrigeration apparatus according to claim 1, wherein the controller is configured to assess that the refrigerant sent to the utilization unit needs to be decreased in quantity when low pressure in a refrigeration cycle decreases to become equal to or less than a predetermined threshold or when the low pressure in the refrigeration cycle is assessed to decrease to become equal to or less than the predetermined threshold.

3. The refrigeration apparatus according to claim 1, wherein the controller is configured to assess whether or not the refrigerant sent to the utilization unit needs to be decreased in quantity in accordance with a state of the utilization unit.

4. The refrigeration apparatus according to claim 3, further comprising:

a space temperature sensor configured to measure temperature in a temperature adjustment target space of the utilization unit; and a memory configured to store target temperature in the space, wherein the controller is configured to assess whether or not the refrigerant sent to the utilization unit needs to be decreased in quantity in accordance with the temperature in the space measured by the space temperature sensor and the target temperature in the space stored in the memory.

5. The refrigeration apparatus according to claim 1, further comprising a casing internal temperature sensor configured to measure temperature in the casing, wherein the controller is configured to open the valve to supply the second heat exchanger with the refrigerant to cause the second heat exchanger to function as a heat absorber when assessing that the refrigerant sent to the utilization unit needs to be decreased in quantity and the temperature in the casing measured by the casing internal temperature sensor is higher than a first predetermined temperature (C1).

6. The refrigeration apparatus according to claim 1, further comprising a casing internal temperature sensor configured to measure temperature in the casing, wherein the controller has, as an operating mode to be selectively adoptable, a casing interior cooling mode in which the valve is opened to supply the second heat exchanger with the refrigerant to cause the second heat exchanger to function as a heat absorber when the temperature in the casing measured by the casing internal temperature sensor is higher than a second predetermined temperature (C2), and the controller is configured to open the valve to supply the second heat exchanger with the refrigerant to cause the second heat exchanger to function as a heat absorber when assessing that the refrigerant sent to the utilization unit needs to be decreased in quantity during the cooling operation, even when the casing interior cooling mode is not selected as an operating mode to be adopted.

7. The refrigeration apparatus according to claim 6, wherein the controller is configured to open the valve to supply the second heat exchanger with the refrigerant to cause the second heat exchanger to function as a heat absorber when assessing that the refrigerant sent to the utilization unit needs to be decreased in quantity during the cooling operation and the casing interior cooling mode being selected as the operating mode to be adopted, even when the temperature in the casing measured by the casing internal temperature sensor is lower than the second predetermined temperature.

8. The refrigeration apparatus according to claim 1, wherein the predetermined capacity is minimum capacity of the compressor.

9. A refrigeration apparatus comprising:

a heat source unit including a compressor configured to compress a refrigerant, a first heat exchanger configured to cause heat exchange between the refrigerant and liquid fluid, a second heat exchanger configured to cause heat exchange between the refrigerant and air, a casing accommodating the compressor, the first heat exchanger, and the second heat exchanger, and a valve configured to switch to supply or not to supply the second heat exchanger with the refrigerant;

a utilization unit including a utilization heat exchanger, the utilization unit and the heat source unit constituting a refrigerant circuit;

a controller configured to control to operate the compressor and open or close the valve; and a temperature sensor configured to measure temperature of the refrigerant flowing in the utilization heat exchanger, wherein the controller is configured to open the valve to supply the second heat exchanger with the refrigerant to cause the second heat exchanger to function as a heat absorber when assessing that the refrigerant sent to the utilization unit needs to be decreased in quantity during cooling operation in which the first heat exchanger functions as a radiator, assess whether or not the refrigerant sent to the utilization unit needs to be decreased in quantity in accordance with a state of the utilization unit, and assess whether or not the refrigerant sent to the utilization unit needs to be decreased in quantity in accordance with the temperature measured by the temperature sensor.

10. A refrigeration apparatus comprising:

a heat source unit including a compressor configured to compress a refrigerant, a first heat exchanger configured to cause heat exchange between the refrigerant and liquid fluid, a second heat exchanger configured to cause heat exchange between the refrigerant and air, a casing accommodating the compressor, the first heat exchanger, and the second heat exchanger, and a valve configured to switch to supply or not to supply the second heat exchanger with the refrigerant;

a utilization unit including a utilization heat exchanger, the utilization unit and the heat source unit constituting a refrigerant circuit;

a controller configured to control to operate the compressor and open or close the valve;

a bypass pipe connecting a suction tube and a discharge tube of the compressor; and a bypass valve provided on the bypass pipe, wherein the controller is configured to open the valve to supply the second heat exchanger with the refrigerant to cause the second heat exchanger to function as a heat absorber when assessing that the refrigerant sent to the utilization unit needs to be decreased in quantity during cooling operation in which the first heat exchanger functions as a radiator, control to operate the bypass valve, and control to open the bypass valve when assessing that the refrigerant sent to the utilization unit needs to be further decreased in quantity after the second heat exchanger functions as a heat absorber during the cooling operation.

* * * * *